United States Patent [19]

Knoops

[11] 4,026,539

[45] May 31, 1977

[54] CONTROL SYSTEM OF A SORTING DEVICE

[75] Inventor: Theodorus Knoops, Asten, Netherlands

[73] Assignee: Oce-van der Grinten N.V., Venlo, Netherlands

[22] Filed: Jan. 8, 1975

[21] Appl. No.: 539,335

[30] Foreign Application Priority Data

Apr. 2, 1974 Netherlands ..... 7404437

[52] U.S. Cl. ..... 271/173

[51] Int. Cl.[2] ..... B65H 29/60

[58] Field of Search ..... 271/173, 64; 270/58

[56] References Cited

UNITED STATES PATENTS

| | | | |
|---|---|---|---|
| 3,618,936 | 11/1971 | Ziehm | 271/173 |
| 3,774,906 | 11/1973 | Fagan et al. | 271/64 |
| 3,845,949 | 11/1974 | Acquaviva et al. | 271/64 |
| 3,848,867 | 11/1974 | Johnson | 271/173 |

*Primary Examiner*—Johnny D. Cherry
*Assistant Examiner*—Bruce H. Stoner, Jr.
*Attorney, Agent, or Firm*—Albert C. Johnston; Gerard F. Dunne

[57] ABSTRACT

Device for the assorted collection of sheets, comprising a transport track and bins situated along this track. The bins are provided with guide organs and each bin can be moved so that its guide organ protrudes into the track so as to guide a sheet into a bin. In the transport track the sheets are transported by means of belts running around a vacuum holddown device so as to hold the sheets onto the belts. The device may be arranged to receive copy sheets exiting from a copying apparatus and may be operated selectively in a first mode in which all similar copy sheets are delivered to a particular bin, or in a second mode in which sheets are collated into a predetermined number of bins. Control circuitry is provided which includes a memory unit for storing a signal condition indicative of delivery of a copy sheet into the last bin of the predetermined number of bins and a manually operable switch for actuating the device to collate a subsequent series of sheets into bins subsequent to the last bin previously utilized.

7 Claims, 25 Drawing Figures

CONTROL SYSTEM OF A SORTING DEVICE

The present invention relates to an apparatus for the assorted collection of sheets, of a type which comprises a series of bins, means for transporting the sheets to be assorted along a track, the bins being situated along this track, and guide organs which can be brought selectively into the path of movement of the sheets to be assorted, in order to transport a sheet into a pertaining bin. Such apparatus is particularly useful for sorting sheets introduced in succession into the track as groups of sheets in such manner that two successive sheets are members of the same group if a predetermined short time interval passes between their introduction into the track, and two successive sheets are members of different groups, forming respectively the last and the first sheet of the different groups, if a time longer than said predetermined time passes between their introduction into the track.

An apparatus of that general type is known from U.S. Pat. No. 3,467,371. Generally, a sorting apparatus is coupled to a copying apparatus, e.g., an electrophotographic copying apparatus, in which copies of the same original can be made quickly and with a defined constant frequency, while the changing from one original to another takes a time longer than the time interval between the production of two successive copies of the same original.

In the known sorting apparatus above mentioned, either every copy of the same original is transported into a different bin or all copies, whether or not of the same original, are transported into the same bin. However, in certain circumstances it is desirable to collect all copies of one original in the same bin, yet to collect the copies of other originals in other bins.

It is an object of the present invention to provide a sorting apparatus whereby any of the above mentioned sorting methods can be performed satisfactorily.

According to the invention, this object is attained in that means are provided to enable the selection and ensuing performance of either of two sorting methods, namely, a first method wherein all sheets of the same group are transported into the same bin and each other group of sheets is transported into another bin, and a second method wherein each $n^{th}$ sheet of every group is transported into the $n^{th}$ bin, the changing from one bin to the next bin in the first sorting method being caused by the longer time lapse between the last sheet of the one group and the first sheet of the next group.

In this way it is achieved that the control system of the sorting apparatus is largely independent of the copying apparatus coupled to it, whereby the electric connection between both apparatus can be restricted, thereby making possible a more flexible use of the sorting apparatus.

Other characteristics and advantages of the invention will become clear from the following description of an illustrative embodiment, wherein reference is made to the accompanying drawings in which.

Figure 23:
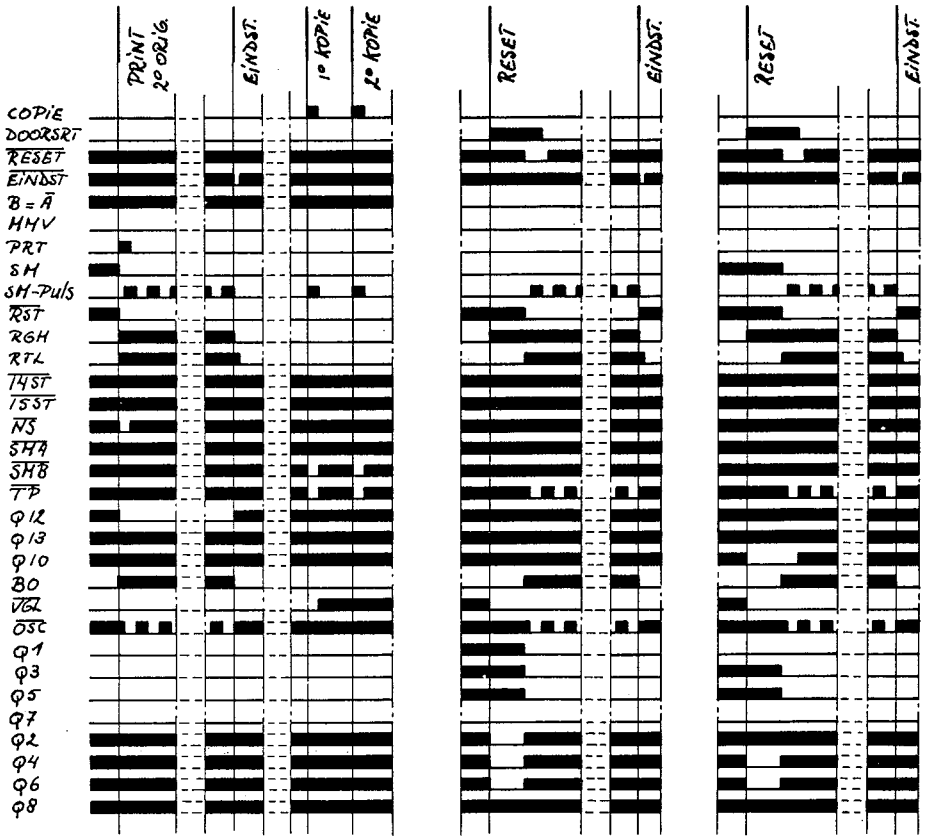

FIG. 23*a* is a diagrammatic illustration of the signal values versus time in a case of sorting method B wherein fifteen copies have been made of the first original; and FIGS. 23*b* and 23*c* are diagrammatic illustrations of the signal values versus time during resetting of the sorting apparatus.

Figure 1:
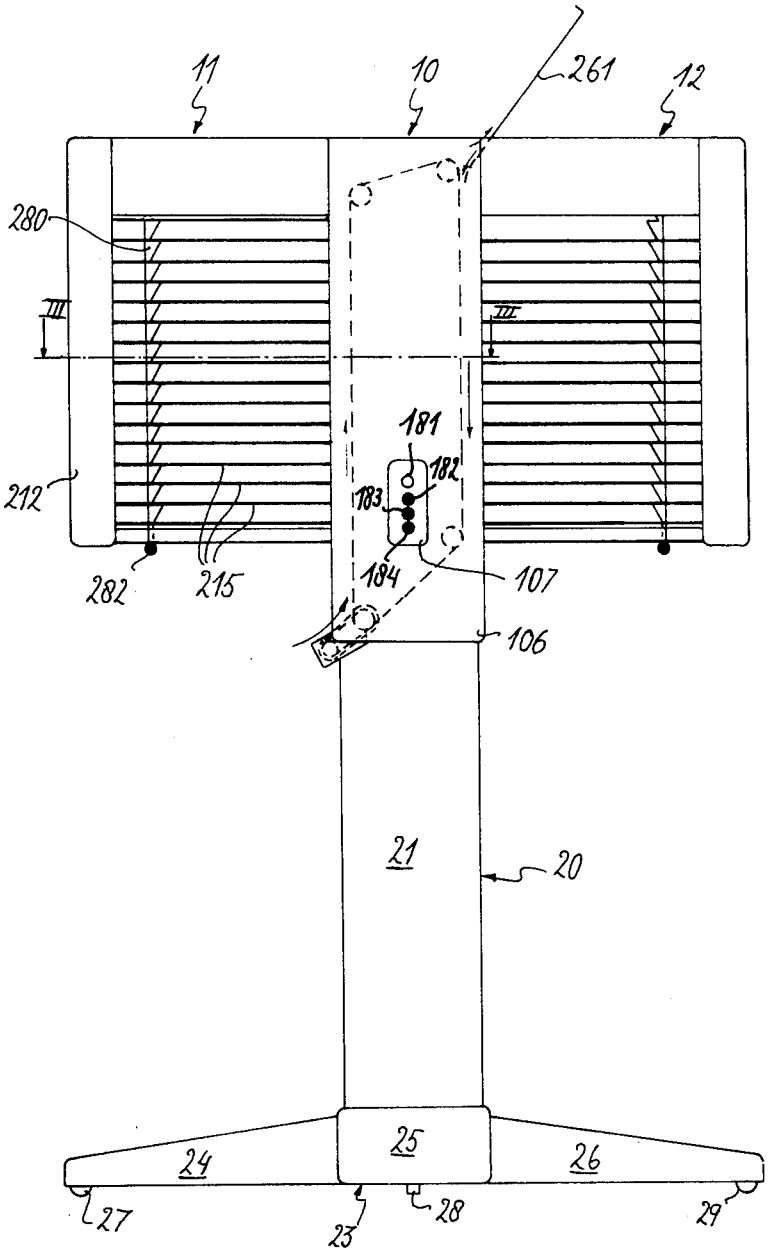
FIG. 1 is a front view of a sorting device according to the invention.
Figure 2:
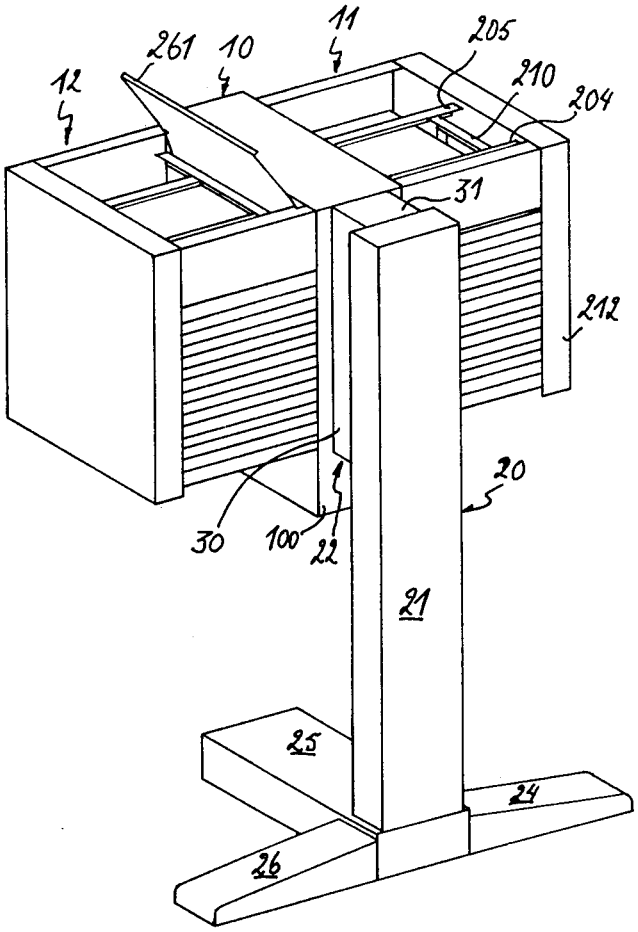
FIG. 2 is a schematic perspective rear view of the sorting device.

The sorting apparatus according to the invention, as represented in FIGS. 1 and 2, mainly consists of a device 10 for transporting the sheets to be assorted, for instance copies, two sorting boxes 11 and 12 installed at either side of the transport device 10, in which boxes the receiving trays to be described are installed. The whole consisting of the transporting device 10 and the sorting boxes 11 and 12 is sustained by a support 20.

This sorting apparatus is described in co-pending U.S. patent application of Breuers et al, Ser. No. 539,542 filed Jan. 8, 1975.

This sorting apparatus can be used in combination with a copying apparatus, for instance an electrophotographic copying apparatus as described in Dutch patent applications Nos. 72 05491 and 72 14704, but it is also useful as a separate unit.

The support 20 consists of a vertical rectangular structural shape, or profile, 21, which rests on an underframe 23 consisting of three horizontal foot structures 24, 25 and 26, under which casters 27, 28 and 29 are installed. Against the upper part of the profile 21 a connecting structure 22 is mounted, consisting for instance of a U-shaped profile 30 which has its base plate fixed against the profile 21 and has fixed on its open side, as by welding, a plate 100 which forms part of the frame of the transport device 10. On the open ends of the U-shaped profile 30 plates 31 are installed.

The transport device 10 (see also FIGS. 3 and 4) comprises a frame which is formed by the plate 100, which forms the rear wall, two side walls 101 and 102 the rear edges of which are connected at screw holes 140 with the rear wall 100, and a front plate 103 which is formed by a metal plate bent in U-shape and fixed via its flanges against the side walls 101 and 102. Towards the front, the side walls 101 and 102 are lengthened by two plates 104 and 105 which are bent into L-shape and against which the front wall 106 of the transport device 10 is fixed. The front wall 106 supports an operation panel 107. Further, a covering plate 108, an upper plate 109 and a bottom plate 110 are fixed between the front wall 103 and the rear wall 100.

The plates 101, 102, 109, and 110 define a space 120 which in cross-section has a parallelepiped shape, and which is laterally closed off by the plates 100 and 103, and at the corners of this space rollers 111, 112, 113 and 114 are mounted rotatably in bearings provided in the plates 100 and 103. Further, a rope pulley 116 is fixed on the rear end of the shaft 115 of the roller 114, which pulley is connected via a rope 117 with a rope pulley 118 fixed on the shaft of an electromotor 119 located in the above-mentioned space 120. The rollers 111, 112, 113 and 114 have a number of relatively narrow endless belts 121, for instance six belts, arranged about them. Some flights of these belts extend outside the space 120 over almost the entire outer sides of the plates 101, 109 and 102, and the other flight extends inside the space 120 along the inner side of the bottom plate 110.

As an underpressure is to be prevalent in the space 120 during the operation of the apparatus, measures have been taken to minimize the quantity of air that can flow inwards via the junctions between the plates which form the space 120. Thus, as appears from FIG. 4, the upper extremity of the plate 101 is bent rectangularly, as well as the left extremity of the plate 109, and between the confronting edges of these two extremities a sealing element 122, for instance consisting of a foam rubber strip, is installed.

A sealing element 123 is also installed between the bent right extremity of the plate 109 and the bent upper edge of the plate 102. The respective lower edge portions of the plates 101, 102 are also bent, so that they partially extend behind the rollers 114 and 113, respectively, while the bottom plate 110 has a bent right extremity the edge of which extends substantially as far as the top of the lower edge portion of the plate 102, so that between these edge portions only a slit is left through which the belts 121 can pass.

Figure 5:
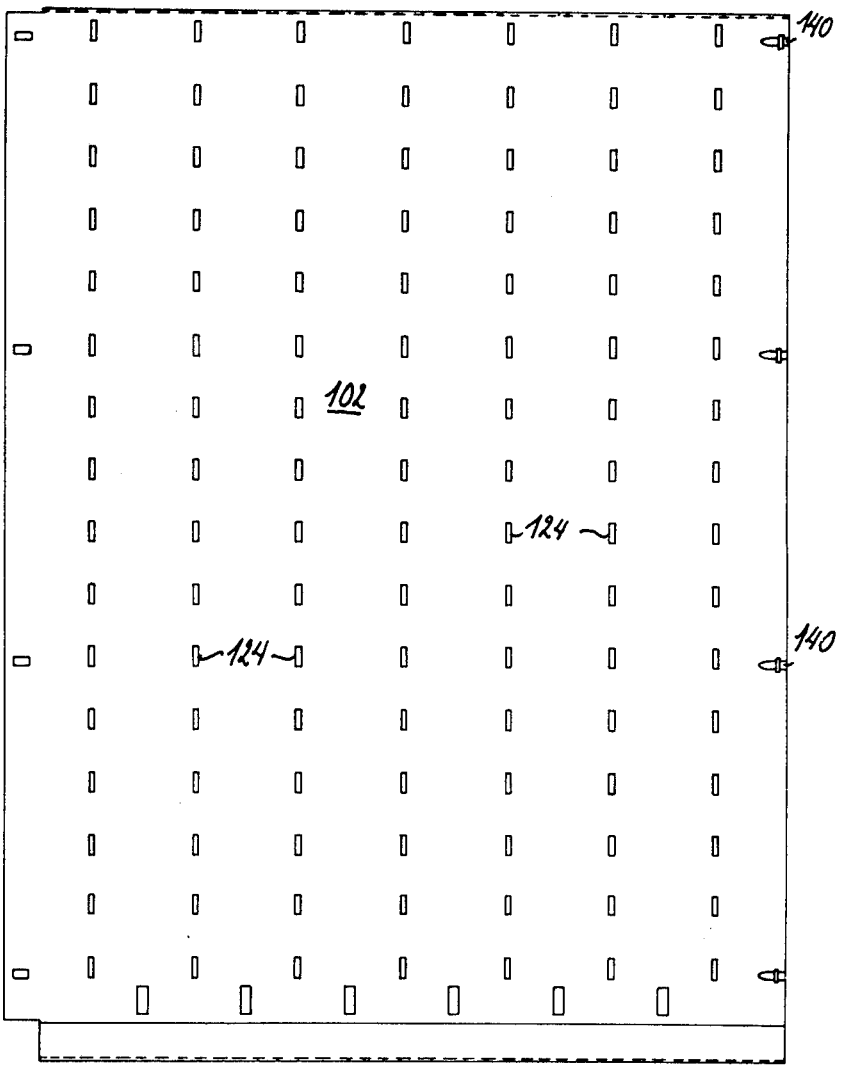
FIG. 5 is a view of a suction plate employed in the sheet transport means.

In each of the plates 101, 102 and 109 a number of groovelike openings 124 are made, as represented in FIG. 5 for the plate 102, at the locations of the interspaces between the belts 121. Further, slide strips 125 are fixed on the plates 101, 102 behind the belts, in order to keep the friction of the belts 121 extending over these plates as low as practicable.

Within the space 120 two ventilators 126 and 127 are installed with their air blowing ends opening outside the space 120. These ventilators maintain a certain underpressure within the space 120, so that an air stream directed inwards takes place by suction via the openings 124.

On each extremity of the shaft 115 of the roller 114 a plate 128 is installed rotatably, and the plates 128 are connected with each other by a plate 129 having fixed thereon two brackets 130 providing bearings in which a shaft 131 is mounted rotatably. Fixed on the shaft 131 is a roller 132 which has a number of rope grooves in its peripheral surface, and the roller 114 also has rope grooves formed therein at the locations of the interspaces between the belts 121. About the two rollers 114 and 132 a number of endless ropes 133 are installed. In the free extremity of at least one of the plates 128 a set screw 134 is installed, which can be screwed against the frame plate 100, so that the roller 132 can be fixed in different positions relative to the roller 114 by rotation about the shaft 115.

Further, a guide plate 135 is fixed between the frame plates 100 and 103 opposite to the upper plate 109 and along the outside of the belts 121.

The sheet transport device operates as follows: When the motor 119 is switched on, the belts 121 as well as the ropes 133 are driven via the roller 114, and when the ventilators 126 and 127 are switched on an underpressure is created within the space 120. When now a sheet, such as a copy, is supplied to the transport device, as schematically indicated by the arrow A (FIG. 4), this sheet is initially carried onwards by the rope 133 and is subsequently sucked against the belts 121 by the underpressure which is prevalent within the space 120.

The sheet is further carried onwards by the belts 121 and, except for some cases which will be explained afterwards in the description of the operation of the complete sorting device, is bent off at the location of the roller 111 via the plate 135 and is guided over the plate 109. At the location of the roller 112, the sheet comes loose from the belts, because here there is no suction, and the sheet arrives onto a reversing device 260 which will be described in greater detail below. When the sheet leaves the reversing device, it is anew sucked against the belts 121 and is moved downwards over the plate 102 until, maximally substantially at the location of the lower edge of the plate 102, it is removed from the belts as will be described further hereinbelow.

At either side of the transport device 10, the left sorting box 11 is installed opposite to the plate 101 and the right sorting box 12 opposite to the plate 102. The left sorting box 11 comprises a frame that includes two vertical L-shaped profiles 200 and 201 of which the respective upper extremities and the lower extremities are connected with each other by T-shaped profiles 202 and 203, respectively, which in the embodiment represented are each formed from two L-shaped profiles welded against each other. In a position vertical to the plane determined by the profiles 200, 201, 202 and 203, two L-shaped profiles 204 and 205 are welded against the T-shaped profile 202 and two L-shaped profiles 206 and 207 against the T-shaped profile 203. The profiles 204 and 205 are connected, respectively, with the profiles 206 and 207 by vertical L-shaped profiles 208 and 209, respectively, while the profile 204 is connected with profile 205 and profile 206 is connected with profile 207 by the horizontal L-shaped profiles 210 and 211, respectively. A U-shaped protection plate 212 is fixed against the free extremities of the profiles 204 through 207.

The frame of the sorting box 11 is hinged to the connecting structure 22. For the purpose two brackets 213 are fixed against the flange plates of the profile 30, which brackets each support a hinge pin 214, and in the rear extremities of the profiles 202 and 203 holes are provided into which the pertaining pins 214 fit. In the active position of the sorting apparatus the frame of the sorting box 11 is in a position, the closed position, whereby the plane determined by the profiles 200, 201, 202 and 203 lies parallel to the plate 101, and a locking device (not represented) is provided to lock the sorting box in this position. The sorting box 11 can be turned away from the plate 101, clockwise as viewed in FIG. 3, in order to facilitate the elimination of any troubles in the transport of the sheets. In the sorting box 11 a number of horizontal receiving trays 215 are installed, which are movable mainly in a horizontal plane between two positions. Each receiving tray comprises a U-shaped profile, having a bottom plate 216, an upright front wall 217 and an upright rear wall 128. The bottom plate 216 has a mainly rectangular shape and has two lateral recesses 219 and 220, which facilitate the removal of assorted sheets.

For reinforcement, ribs 221 lying perpendicular to the front and rear walls 217 and 218 are formed in the bottom plate 216, while oblong openings 222 are provided between the ribs 221 and parallel to them. The purpose of these openings will be described below.

Against the upright front wall 217 of all but one of the trays 215 a scraping organ 223 is fixed. Each scraping organ 223 comprises a U-shaped profile 224 which is clamped onto an upright front wall 217. One of the U-legs of the profile 224 is extended to the other side of the body piece over the full length of the scraping organ 223, forming a flange 225, and over the length of the profile scraping blades 226 are formed at certain mutual distances. These blades mainly consist of small plates formed perpendicularly on the profile in the form of oblique-angled triangles one side of which coincides with the body piece of the U-shaped profile 224. In the case of the left sorting box the free, acute angle of each scraping blade 226 is directed downwards.

A small triangular plate 227 (FIG. 3) is fixed to each extremity of each scraping organ 223. This plate 227, for instance, is integral with the scraping organ 223, or it is fixed against the scraping organ 223 by any known technique. A pin 228 is provided on that side of each small plate 227 which faces away from the scraping organ 223, by which pin the receiving tray can be connected swingably with the frame of the sorting box, as described more particularly below.

The upright rear wall 218 of the receiving tray 215 also has a U-shaped profile 229 fixed thereto by being clamped thereon. In the embodiment shown this profile is shorter than the scraping organ 223. On the free or outer side of the profile 229 two triangular brackets 230 are formed at the center and as extensions of the U-legs of the profile. These brackets face each other, and their sides directed towards each other are provided with recesses lying opposite to each other, which receive the shaft ends of a small roller 231. The small roller 231 cooperates with a cam disk by which the receiving tray 215 can be moved between two positions as described more particularly below.

Near each extremity thereof, each profile 229 has a console 232 formed on its side facing away from the receiving tray, and the two consoles 232 of a same profile 229 have flanges which face towards each other. On each of these flanges a pin 233 is formed by which the receiving tray 215 can be connected swingably with the frame of the sorting box 11.

In the illustrated embodiment of the receiving tray 215, the tray itself is made of metal, such as aluminum, while the scraping organ 223 and the profile 229 are made of plastic, for instance by injection molding. However, the tray 215 and the profiles 223 and 229 can also be made completely of metal, and according to another embodiment the receiving tray 215 and the profiles 223 and 229 are manufactured as one plastic whole, for instance by injection molding. In the latter case the body pieces of the profiles 223 and 229 are integral with the upright walls 217 and 218, respectively.

Figure 6:
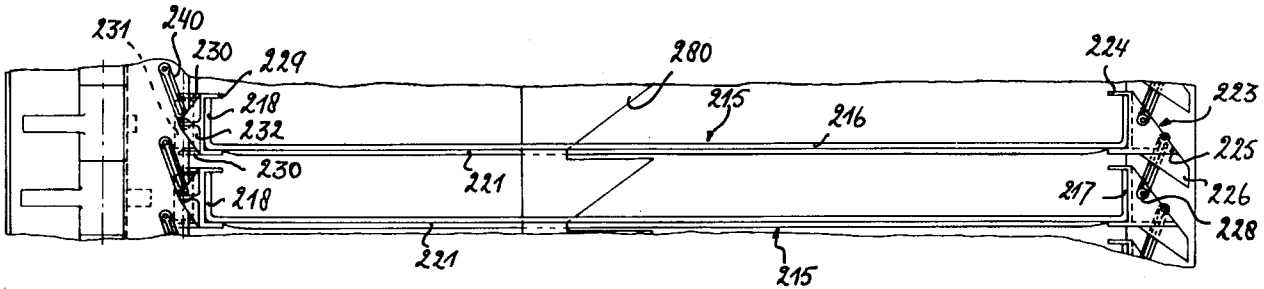
FIG. 6 is a side view of a number of bins or receiving trays and of means suspending these receiving trays in the sorting device.

As previously stated, the receiving trays 215 are provided with oblong openings 222 which, for the various receiving trays 215 in the sorting box, lie one above another. Through each series of superimposed openings 222 a bar 280 is inserted, which bar extends over substantially the full height of the sorting box. In principle, each bar can be smooth, but, as represented in FIGS. 1 and 6, bars 280 preferably are used which have a saw-toothed edge at the side directed towards the plate 101 and have the smallest sections between their teeth aligned with the bottom plates 216 of the receiving trays 215. The upper extremities of the bars 280 are connected with each other by a rod which rests freely on the profiles 204 and 205, so that the whole assembly consisting of the bars 280 and the rod can easily be displaced along the openings 222 in perpendicular direction relative to the walls 217 and 218. The lower extremities of the bars 280 may also be connected with each other by means of a relatively heavy rod 282 (FIG. 1), so that the bars will not be displaced too easily. The bars 280 are positioned so that during the operation of the apparatus the distances between the bars 280 and the front edge 217 are slightly greater than the length of the sheets to be laid down in the receiving trays. By means of the bars 280 the leading edges of the sheets laid down in a receiving tray 215 are caused to lie substantially in register, and not across one another.

Figure 9:
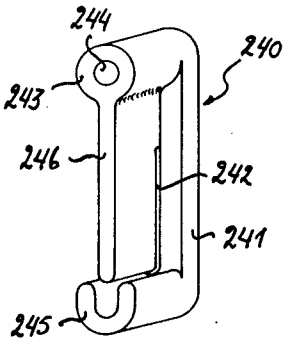
FIG. 9 is a perspective front view of an element of the means shown in FIG. 6 for suspension of the receiving trays.

For suspending the receiving trays swingably in the sorting box, links such as the link 240 represented in FIG. 9 may be used. The link 240 comprises an oblong body piece 241 provided with an oblong groove 242 which extends in the lower part of the link. A bushing 243 formed on the upper extremity of the body piece is provided with a central hole 244. A troughlike addition 245 is formed on the lower extremity of the body piece, with its upper edges ending substantially at the level of the lower extremity of the groove 242 and its trough having a semicircular cross-section. From the lower extremity of the bushing 243 a flange 246 extends downward, which flange is also connected with the body piece 241 up to the upper extremity of groove 242. The flange 246 ends substantially at the level of the upper edge of the troughlike addition 245.

The flanges of the profiles 200, 201, 208 and 209 that lie perpendicular to the plate 101 are each formed with a number of holes therein, which lie above and at uniform distances from each other. These holes have pins 235 fixed therein; for instance, solid pins may be force fitted into the holes, but, preferably, tightening pins are used which are clamped in the holes in the said flanges so that respective parts of the pins 235 protrude inwards and towards each other near the profiles 200 and 201, and protrude towards and away from each other near the profiles 208 and 209. The hole 244 of a link 240 is shoved onto the protruding part of of each pin 235, having been made for slide-fitting onto the pin. Thus, the links 240 can pivot about the pins, while the body piece 241 of each link lies against a profile flange. Further, the holes in the flanges of the four profiles are located so that at each level four holes and four pins therein lie in a common plane. Thus, four links slid onto the four pins 235 are suspended planularly. The pins 228 and 233 of a receiving tray are supported in the troughlike additions 245 of these four links. For seating a pin 228 or 233 into the trough of a link 240, the related link flange 246 is deflected sidewards. When the pin is in place and the flange 246 is released, the flange returns to a position above the troughlike addition 245. The pins 228 and 233 thus are confined so that they cannot suddenly come loose from the links 240.

In this way, in the illustrated embodiment, fifteen receiving trays, all positioned horizontally and one above another, are installed in the left sorting box, with the scraping organ of each receiving tray lying opposite to the plate 101, and the scraping blades thereof lying opposite to the interspaces between the belts 121.

By reason of the swingable suspension of the receiving trays, and while there are no external forces acting on them, all receiving trays will occupy a position of rest, namely their lowest position, which is chosen in such a way that the points of their scraping blades 226 lie at a distance away from the belts.

Figure 7:
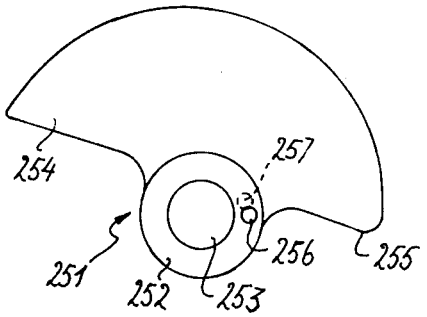
FIG. 7 is a plan view of the upper side of a cam to be used for controlling the movement of the receiving trays.
Figure 8:
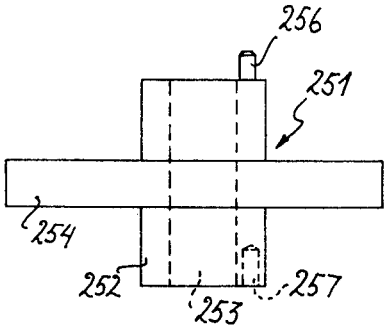
FIG. 8 is a side view of the same cam.

In the space between the plate 212 and the profiles 229 of the receiving trays 215 a vertical shaft 250 is installed, which at its lower end is rotatably mounted in a cross connection between the profiles 206 and 207 and at its upper end is rotatably mounted in a cross connection between the profiles 208 and 209. The upper end of the shaft 250 is coupled with the drive shaft of an electromotor, for instance a step motor, and a number of cams 251, each of the form represented in FIGS. 7 and 8, are fitted onto the shaft 250.

Each cam 251 comprises a bushing 252 having a central hole 253 to receive, and enabling the cam to be shoved over, the shaft 250. A cam disc 254 is formed on the bushing and has a profile as represented in FIG. 7. That is, no cam disc is present over approximately a half of the circumference, while from its extremity 255 the cam disc has a radius which gradually increases over approximately the other half of the circumference.

On the upper side of each bushing 252 a pin 256 is formed, and in the lower side of each bushing 252 a cylindrical recess 257 having nearly the same diameter as the pin 256 is formed. The pin 256 and the recess 257 lie on planes radial to the shaft 250 which include an angle of for instance 15°. The cams 251 are shoved onto the shaft 250 in such a way that the recess 257 of each cam engages over the pin 256 of the nearest lower cam, so that two successive cams are offset over the above-mentioned angle of 15°.

The dimensions of the bushings 252 are chosen so that the cam discs 254 lie opposite to the small rollers 231. However, at the level of the lowest receiving tray no cam is installed, but instead, for instance, only a spacing bushing, as will become clear in the description of the operation.

Figure 3:
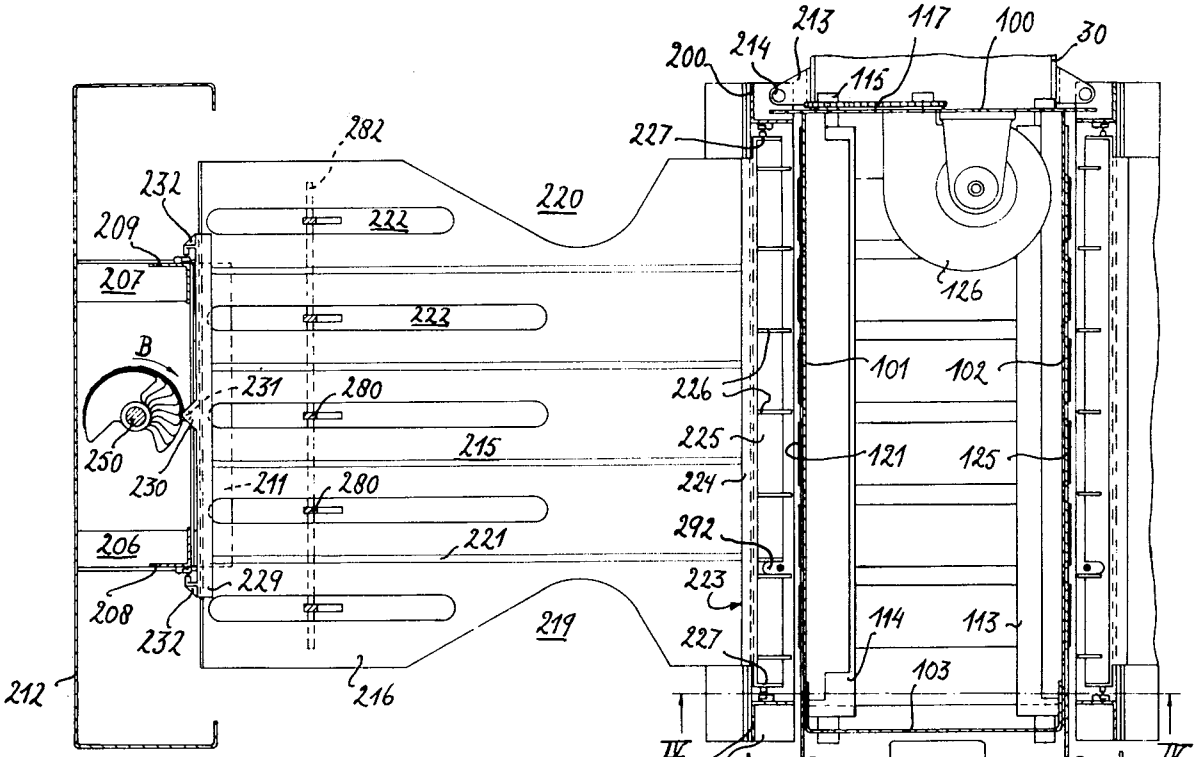
FIG. 3 is a section of a part of the sorting device taken along line III—III in FIG. 1.

The relative dimensions are chosen in such a way that upon a rotation of the shaft 250 in the direction of the arrow B in FIG. 3, a cam disc first contacts the pertaining small roller 231 with the cam part 255 having the smallest radius. Upon further rotation the cam disc will push against the roller concerned, so that the receiving tray is moved into the direction toward the plate 101. When that part of the cam disc 254 which has the greatest radius is pushing against the roller 231, the receiving tray will have been displaced so far in the direction of the plate 101 that the points of the scraping blades on the tray extend between the belts 121.

Figure 11:
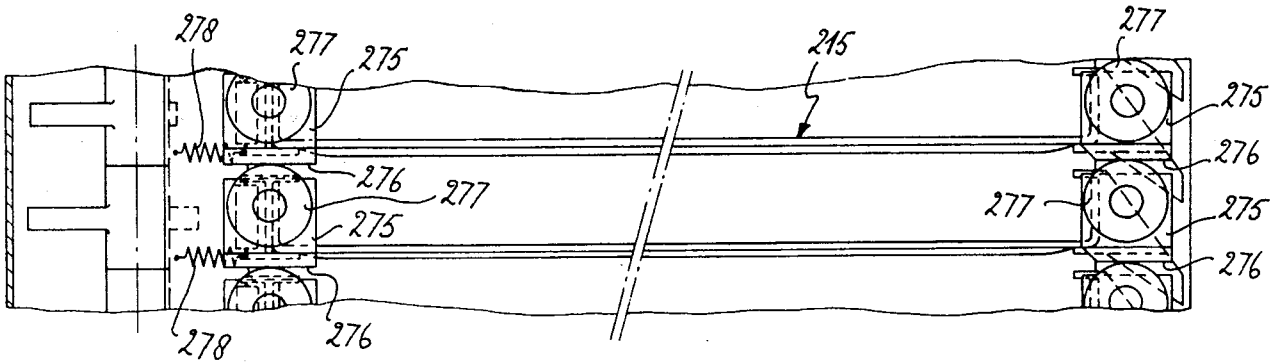
FIG. 11 is a side view of a number of receiving trays having a modified construction for suspension of the trays.

FIG. 11 illustrates another embodiment of structures suitable for the suspension of the receiving trays 215. In this embodiment both the front upright wall 217 and the rear upright wall 218 of the receiving tray are provided at either extremity with a plate 275. Each plate 275 has a horizontal flange 276 formed on its lower side. A freely rotatable roller 277 mounted in each plate 275 is arranged so that this roller can cooperate with the flange 276 of the plate 275 which belongs to the next higher receiving tray. The extremities of the rear upright edge 218 also have springs 278 fixed thereto, and the other ends of these springs are connected with the profiles 208 and 209 so that the receiving tray are always being pulled to the left as viewed in FIG. 11.

Figure 4:
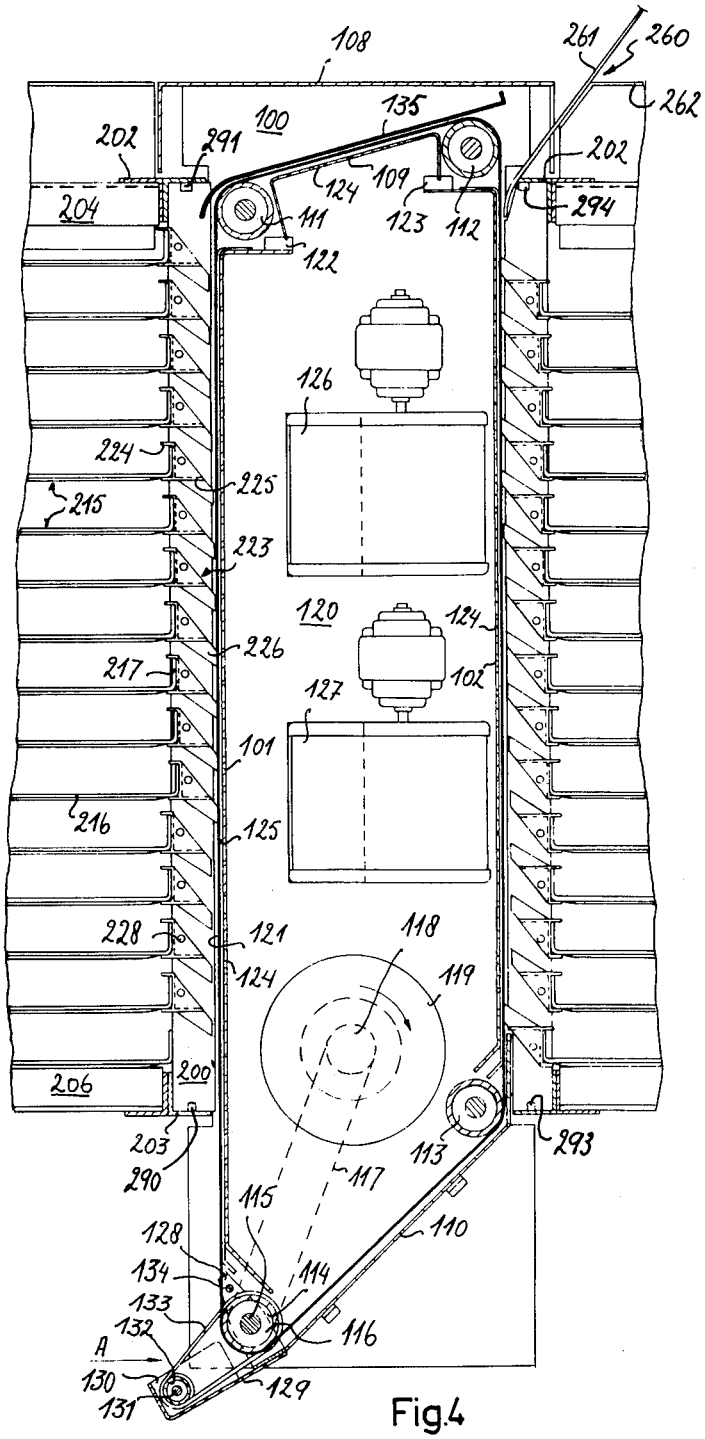
FIG. 4 is a section of a part of the sorting device, taken along line IV—IV in FIG. 3.

The operation of the transport device 10 together with the left sorting box is as follows: When a sorting run starts, the cam shaft 250 is in a zero position at which it is turned so that the lowest but one receiving tray 215 is displaced as far as possible in the direction toward the plate 101. As previously stated, the lowest receiving tray is not displaceable and moreover that tray, as represented in FIG. 4, may be firmly installed in the frame. When now via the ropes 133 and the belts 121 a sheet is supplied, this sheet will be deflected away from the belts 121 by the points of the scraping blades 226 of the lowest but one receiving tray, which points protrude between the belts 121, and will be guided off beneath the blades in such a way that the sheet will be transported into the lowest receiving tray. If the following sheet is to be deposited into the lowest but one tray, the shaft 250 is turned through an angle of for instance 15°, as a result of which the cam disc of the lowest but one receiving tray no longer engages the roller of the pertaining receiving tray, which tray returns to its rest position where the points of its scraping blade lie at a distance away from the belts. As another result of the turning step of the shaft, the lowest but two receiving tray is now displaced by its cam as far as possible in the direction of the plate 101, so that the points of its scraping blades 226 protrude between the belt 121 and cause the following copy sheet supplied via the transport device 10 to be deposited into the lowest but one tray. If the next following sheet is to be deposited into the lowest but two receiving tray, the shaft 250 is a new turned through 15°, etc.

When at a certain moment it is desired to deposit the following sheet again into the lowest tray, the shaft 250 is turned so far that again the zero position described above is reached, and the run can start once more.

As appears from FIG. 1, sixteen receiving trays are represented in the left sorting box, wherein the lowest receiving tray is not provided with a scraping organ, while the uppermost receiving tray is not active as such but only serves to make it possible to transport a copy sheet into the highest but one receiving tray. The same applies if receiving trays according to FIG. 11 are used.

When more than fifteen sorting trays are needed, the right-hand sorting box 12 is available for that purpose. The sorting box 12 differs in only a few details from the sorting box 11. Only these details will be described below, and for the same parts the same references will be used.

The description already given of the operation of the transport device 10 mentioned that when a sheet arrives at the height of the roller 112, the sheet is further transported to a sheet reversing device. This is desirable because otherwise the sheet would be laid down with the wrong side upwards in the receiving trays of the sorting box 12.

The sheet reversing device 260 consists of a guide organ 261, for instance a thin metal plate or a grate, mounted at an angle of for instance 50° to the horizontal. This guide organ 261 is fixed against the profile 202 of the sorting box 12, and further rests on the upper plate 262 of the sorting box 12. The dimensions of the plate 261 are greater than the greatest dimensions of a sheet to be assorted. The operation of the reversing device 260 is as follows: When a copy sheet has arrived at the height of the roller 112, it cannot follow the rather sharp bend which the belts make at this location, and it will be further transported almost horizontally until its leading edge pushes against the guide organ 261. Here this leading edge will be guided upwards, and the sheet will be pushed further upwards along the guide organ. This is continued until the rear edge also comes loose from the roller 112, whereupon as a result of the speed and gravity, the sheet is brought slightly further onto the guide organ and will fully rest on it. Subsequently the sheet slides downwards along the guide organ 261, until the edge which previously had been trailing is sucked against the belts 121 by the suction through the openings in the plate 102 and is now taken along by the belts as the leading edge. From then on, the further transport is identical to the transport along the plate 101.

Figure 10:
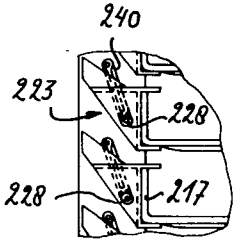
FIG. 10 is a fragmentary view of means for the suspension of a number of receiving trays.

Another difference between the left and right sorting box lies in the installation of the scraping organs which indeed are identical for the two sorting boxes but which in the right sorting box have their points directed upwards, as represented in FIG. 10. Consequently, when a receiving tray has been fully displaced in the direction toward plate 102, the sheets are deposited into this same tray, and not into the nearest lower tray as in the left sorting box.

Further, the uppermost receiving tray falls away in the right sorting box, while in the embodiment represented the lowest receiving tray of the right hand box is fixed in a position where its scraping blades protrude between the transport belts 121, so that all sheets which have not been deposited into one of the preceding trays are collected in it. On the operation panel 107 four switches 181, 182, 183 and 184 are provided, the uppermost switch 181 being the main switch of the sorting apparatus.

In this sorting apparatus the sheets can be sorted according to two systems or sorting methods and an additional feature is provided by the so-called sorting-up mode of operation.

According to the first sorting method, called method A, each copy of the same original is transported into the same bin, i.e., each copy of the first original into the first bin, each copy of the second original into the second bin, etc. Consequently, in the embodiment illustrated, the cam shaft only has to be turned through the angle of 15° to bring the next bin into its sheet receiving position when the original is exchanged for another. The sorting apparatus operates according to this method A when switch 182 has been actuated.

According to the second sorting method, called B, the *n* copies of one original are distributed over the first *n* bins of the sorting apparatus, whereupon the *n* copies of each following original are likewise distributed over the same first *n* bins of the sorting apparatus, and this method is continued until the switch 184 is actuated in a manner described below. Consequently, in the embodiment represented, the cam shaft has to be turned through an angle of 15° after each copy is deposited into its pertaining bin, and has to return to its starting position after copy *n*. The sorting device operates according to this method B when switch 183 has been actuated.

Upon sorting the copies of the first set of originals according to method A or B, for instance into the first *n* bins, it is possible to provide a sorting-up by actuating switch 184 in a manner described below, whereupon the bin $(n+1)$ is used as the first bin for a following sorting of copies. This sorting-up mode is especially useful if, for instance, copies of a first set of originals are sorted in accordance with method B, and the copies of a second set of originals are to be sorted in accordance with the same method, because it is not necessary to remove from the bins the copies of the first set of originals, which are already sorted.

In the following description of the control system of the sorting apparatus, it is assumed that the sorting apparatus has 30 bins, i.e., 15 bins in the left sorting box and 15 bins in the right sorting box. Further, each cam shaft is assumed to be driven by a stepping motor. The shaft of this stepping motor is turned through an angle of 15° by each step. This stepping motor is of the type having six rotor and eight stator windings, each pair of diametrically opposed stator windings being connected in series. When the stator windings are consecutively energized in the correct sequence, the rotor will turn through an angle of 15° upon each energizing impulse. Therefore, it is necessary to energize each pair of stator windings separately and in the correct sequence.

In an apparatus having two sorting boxes and therefore two stepping motors, it is undesirable that both stepping motors be energized at the same time. In such a sorting apparatus, it is therefore necessary that the eight pairs of stator windings be energized at the right moment and in the correct sequence, i.e., each pair of stator windings has its own energizing circuit.

Figure 12:
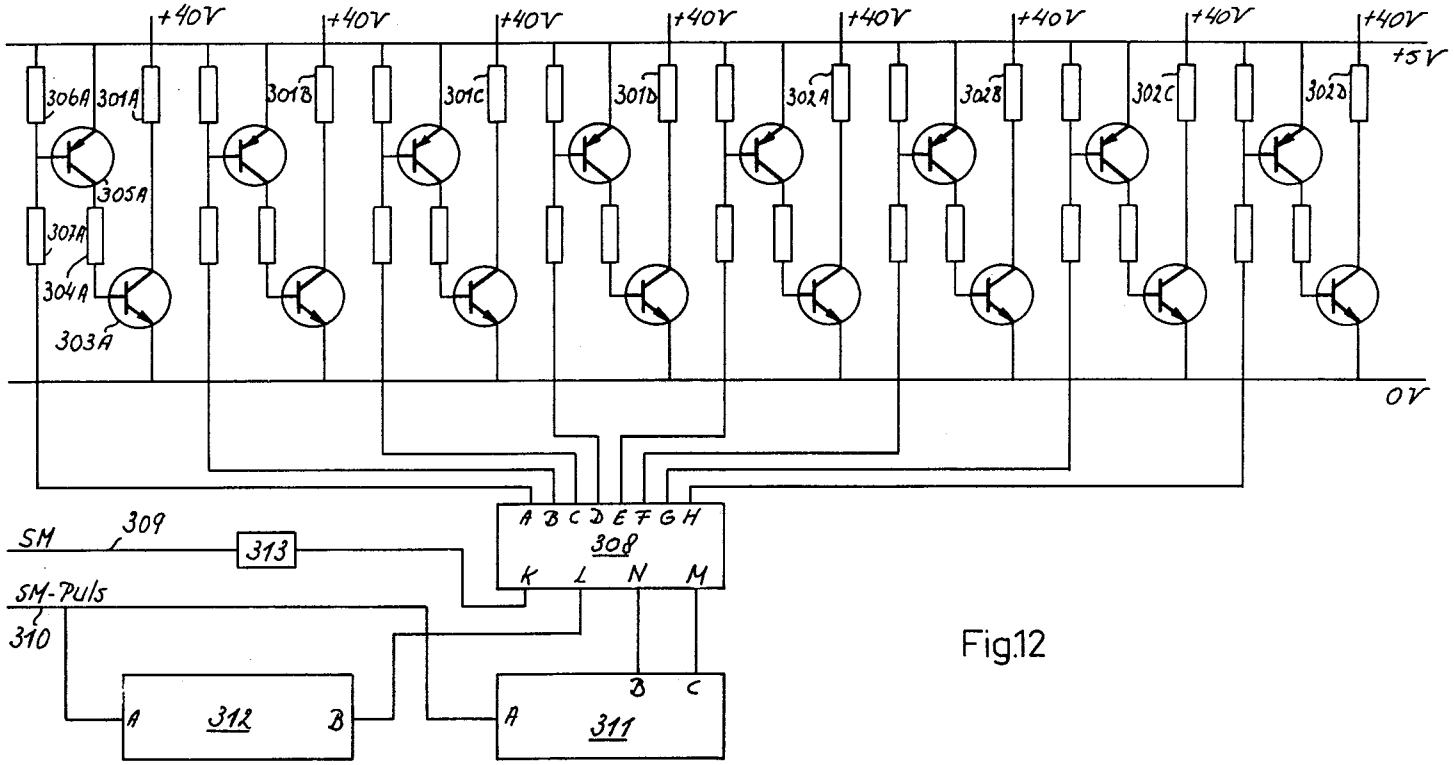
FIG. 12 is a diagram of the electric circuit for controlling the operation of the stepping motors.

In FIG. 12 the stator windings of the left stepping motor are designated 301A, 301B, 301C and 301D respectively, and those of the right stepping motor 302A, 302B, 302C and 302D respectively.

One terminal of each winding is connected for instance to the terminal + 40V of a DC-potential source, whereas the other terminal of each winding is connected to an activating circuit which, in case a winding is to be energized, accomplishes the connection of the other terminal of said winding to the terminal OV of the DC-source.

Each activating circuit comprises a first transistor 303, which in the described embodiment is of the npn-type, the emitter of which is connected to the terminal OV and the collector to the terminal of the respective winding 301 or 302. The base of the transistor 303 is via a resistor 304 connected to the collector of a second transistor 305, the emitter of said second transistor being connected to the terminal +5V of a DC-potential source, and the base of said second transistor on the one side, being connected via a resistor 306 to the terminal +5V and on the other side via a resistor 307 to the output of a control device or converter 308.

In this way each energizing circuit is connected to another output of the converter 308. As will be described below, each output potential or signal of the converter is high, i.e. is +5V, in the rest position or if no winding is to be energized, which situation hereafter will be designed by indicating that each of the output signals of the converter is one. In this way the windings 301A, 301B, 301C, 301D, 302A, 302B, 302C and 302D respectively are connected to the outputs A, B, C, D, E, F, G and H respectively of the converter 308.

If one of the windings, for instance winding 301A is to be energized, the signal level of the relevant output of the converter, in this case of the output 308A, must become zero, i.e., the voltage in this output will become O V. How and when this happens will be described in more detail below. The operation of the energizing circuit will be described with relation to the winding 301A, but the same applies for the other windings.

As the output 308A of the converter 308 becomes zero, the potential of the base of the transistor 305A, which was originally +5V, will decrease to a lower value, so that the transistor 305A will become conductive, whereupon the potential of the base of the transistor 303A, which was initially zero, will increase until a value is reached, whereby the transistor 303A becomes conductive, whereby the winding 301A is connected to the terminal O V of the DC-source and thus will be energized, thereby turning the stepping motor over one step or 15°.

The task of the control circuit for the different activating circuits is to combine a signal SM, indicating which one of the stepping motors is to be energized, and a signal SM-PULS which is responsible for the energizing of this stepping motor, and to convert this combination into a signal zero in one of the outputs of the converter 308.

Therefore the control circuit, of which the cited converter 308 is a part, has two inputs and eight outputs, i.e., the outputs 308A up to an including 308H of the converter 308 and the inputs 309 and 310. One of the inputs, i.e. the input 309 is connected to a signal generator of the signal SM, which signal is "zero" if the left stepping motor is to be used, and is "one" if the right stepping motor is to be used. The other input 310 is connected to a signal generator of the signal SM-PULS, which signal is changes from "one" to "zero" every time a winding of a stepping motor is to be energized. The signal generators of the signals SM and SM-PULS will be described in more detail in the following description.

The control circuit comprises the converter 308, a counter 311 and a monostable multivibrator 312. In the disclosed embodiment this monostable multivibrator 312 is formed by an integrated circuit of the type TTL-74123 as sold for instance by Texas Instruments, the pulse width of which can be controlled by choosing the appropriate values for the components of an RC-circuit which may be connected externally to the integrated circuit. The pins 2 and 3 of the integrated circuit are connected via a resistor to the terminal +5V of the DC-source, and the pins 14, 15 and 16 are connected to a RC-circuit defining the width of the pulse generated in the output of pin 4 when the signal in the pin 1 changes from one to zero. The pin 1 corresponds to the input 312A and is connected to the input 310, so that each time the signal SM-PULS changes from one to zero, the signal in the pin 4 corresponding to the output 312B becomes temporarily zero, the pulse width being defined by the external RC-circuit.

The counter 311 of the disclosed embodiment is formed by an integrated circuit TTL-7473 as sold by Texan Instruments, the pins 12 and 5 of which being interconnected, so as to form a digital ring counter having four bits corresponding to the number of pairs of windings of each stepping motor.

In fact the counter 311 is formed by two JK-flipflops with forced input, the Q1-input of the first JK-flipflop being connected to the T-input of the second JK-flipflop. Further, the J, K and S-inputs of each JK-flipflop are connected via a resistor to the terminal +5V of the DC-source so that a signal "one" is present in those inputs. In this way it is achieved that every time the signal in the T-input of the first flipflop is changes from one to zero, the signal in the output Q1 is inverted (the Q2-output is not used). If the signal Q1 was originally one, it becomes zero, whereby the signal in the T-input of the second flipflop is changed from one to zero, thereby inverting the output signal Q3. (The Q4-output is not used). The T-input of the first flipflop corresponds to the input 311A, whereas the outputs Q1 and Q3 correspond to the outputs 311B and 311C respectively. The input 311A is connected to the input 310, connected to the signal generator of the signal SM-PULS.

Starting from the condition that the output signals 311B and 311C are one, the following conditions are obtained subsequently, each time input signal 311A is changing from one to zero, wherein *n* is the number indicating the times that the input signal 311A has been changed from one to zero.

| n | 311B | 311C |
|---|---|---|
| 0 | one | one |
| 1 | zero | zero |
| 2 | one | zero |
| 3 | zero | one |
| 4 | one | one |

It must be noted that the changing from zero to one of the input signal 311A has no influence on the output signals 311B and 311C.

In the disclosed embodiment, the converter 308 is formed by an integrated circuit TTL-7442 as sold by Texas Instruments, which is in fact a BCD-to-decimal decoder used here in a special way.

The converter 7442 has four inputs, corresponding to the pins 15, 14, 13 and 12 respectively are eight outputs Q0, Q1, Q2, Q3, Q4, Q5, Q6 and Q7 corresponding to the pins 1, 2, 3, 4, 5, 6, 7 and 9 respectively. In the disclosed circuit the inputs $I_1$, $I_2$, $I_4$ and $I_8$ correspond to the inputs 308N, 308M, 308K and 308L respectively, whereas the outputs Q0 up to including Q7 correspond to the outputs 308A up to and including 308H, respectively.

The function table of the converter is as follows:

| L | K | M | N | A | B | C | D | E | F | G | H |
|---|---|---|---|---|---|---|---|---|---|---|---|
| L | L | L | L | L | H | H | H | H | H | H | H |
| L | L | L | H | H | L | H | H | H | H | H | H |
| L | L | H | L | H | H | L | H | H | H | H | H |
| L | L | H | H | H | H | H | L | H | H | H | H |
| L | H | L | L | H | H | H | H | L | H | H | H |
| L | H | L | H | H | H | H | H | H | L | H | H |
| L | H | H | L | H | H | H | H | H | H | L | H |
| L | H | H | H | H | H | H | H | H | H | H | L |
| H | ? | ? | ? | H | H | H | H | H | H | H | H |

As above mentioned, the outputs 308A up to and including 308H are connected to the respective windings of the stepping motors, and if one output signal becomes zero, the corresponding winding is energized. The input 308L is connected to the output 312B of the monostable multivibrator 312, and as it becomes clear from the function table none of the outputs 308A up to and including 308H can become zero or L as long as the output of the monostable multivibrator 312 is one or H, i.e., as long as the signal SM-PULS in the input 310 is not changing from one to zero. As soon as the signal SM-PULS is changing from one to zero, the output 312B becomes temporarily zero, and one of the outputs 308A up to and including 308H may become zero depending on the other input signals 308K, 308M and 308N.

The input 308K is connected to the input 309 connected to the signal generator of the signal SM, which signal being zero if the left stepping motor is to be used, and being one if the right stepping motor is to be used. From the function table it becomes clear that if the input signal 308L is zero and the input signal 308K is zero, only the input signals 308A up to and including 308D can become zero, and therefore only the windings of the left stepping motor can be energized, whereas if the input signal 308L is zero and the input signal 308K is one, only the output signals 308E up to and including 308H can become zero, and therefore only the windings of the right stepping motor can be energized. Which one of the windings of the groups 308A up to and including 308D or 308E up to and including 308H is energized is dependent on the input signals 308N and 308M connected to the outputs 311B and 311C respectively of the counter 311.

If the function tables of the converter 308 and of the counter 311 are considered together, it becomes clear that when the signal SM is zero and therefore also the input signal 308K, and when the signal SM-PULS is for the first time changed for one to zero, the output signal 308A becomes zero. At the second changing of the signal SM-PULS from one to zero, the output signal 308B becomes zero etc. The same is true for the right stepping motor if the signal SM is one. It must be noted that in the connection between the input 309 and the input 308K there is provided a delaying device 313, such as a RC-circuit, whereby the changings of the signals SM are transmitted with some retardation to the input 308K.

Hereafter it will be described how the different signals that are important for the specific control circuit are generated and which meaning they have.

On the profile 203 there is provided a light source 290, see FIG. 4, whereas against the underside of the profile 202 there is provided a photoresistor 291 which is influenced by the light source 290. The flanges 225 of the bins are provided with recesses 292, see FIG. 3, so that the light path between the light source 290 and the photoresistor 291 is not interrupted by the bins, whatever being the positioned of the latter.

Figure 13:
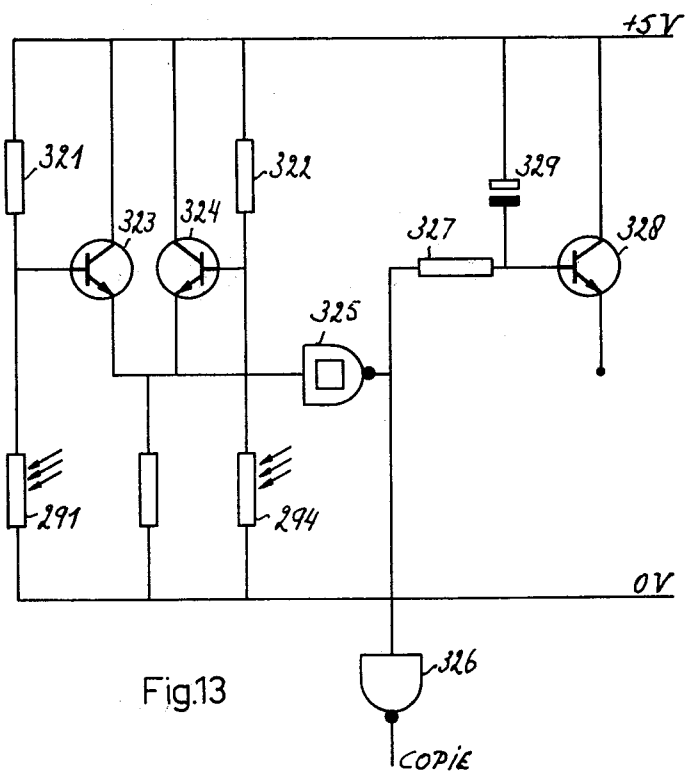
FIG. 13 is a diagram of the electric circuit of the signal generator for the signal COPIE.

The light path between the light source 290 and the photoresistor 291 can be interrupted by a copy which is being transported into one of the bins of the left sorting box. The same construction is repeated in the right sorting box, wherein there are provided a light source 293 and a photoresistor 294, the light path between said elements being interrupted only when a copy is being transported into one of the bins of the right sorting box. Each of the photoresistors 291 and 294 is connected in series to a resistor 321 and 322 respectively, thus forming a potential divider between zero and 5V (see FIG. 13), whereby the potential of the base of a transistor 323 and 324 respectively, is controlled. The transistors 323 and 324 are of the npn-type and their collectors are connected to the terminal +5V of a DC-source.

If a copy sheet is being transported into one of the bins of the left sorting box, this copy sheet will interrupt temporarily the light path between the light source 290 and the photoresistor 291, thereby increasing the resistance of the photoresistor 291 and also the potential of the base of the transistor 323 so that the latter becomes conductive. As soon as the copy sheet is completely transported into the bin, the beam from light source 290 reaches again the photoresistor 291, thereby decreasing the resistance of the latter and also the potential of the base of the transistor, so that the transistor 323 becomes nonconductive again. The same is true if a copy sheet is transported into a bin of the right sorting box, the beam of light normally activating the photoresistor 294 being interrupted, thereby making conductive the transistor 324 for the time of the interruption.

The signal emitted by the transistor 323 as well as the signal emitted by the transistor 324 are used as input signals of a Schmitt-trigger 325 with inverted output. The input to the Schmitt-trigger becomes temporarily one each time a copy is transported into one of the bins, either in the left sorting box, or in the right sorting box, and this signal is inverted by the Schmitt-trigger into an inverted pulse having straight sides. The output of the Schmitt-trigger 325 is connected to the input of a gate 326 having one input, whereby the signal is again inverted. Therefore, in the rest position the output signal of the inverter 326 is zero, whereas each time a copy is transported into one of the bins, the output of the inverter 326 becomes temporarily one (positive pulse with rectangular sides). The output of the inverter 326 corresponds to the signal "copie".

Via a resistor 327, the output of the Schmitt-trigger 325 is also connected to the base of a transistor 328, which resistor 327 via a capacitor 329 is also connected to the terminal +5V of the DC-source. The collector of the transistor 328 is also connected to the terminal +5V, whereas the emitter is connected to a circuit, which will not be described in more detail, but which, if the transistor 328 becomes nonconductive, switches off the copying apparatus coupled to the sorting apparatus.

In the rest position, i.e., if no copies are transported into the bins both electrodes of the capacitor 329 have a potential of +5V. Consequently the transistor 328 is conductive. Normally the pulse width of the output of the Schmitt-trigger 325 is so narrow that the RC-circuit formed by the resistor 327 and the capacitor 329 has no function. However, if a copy sheet interrupts the light path between the light sources 290 or 293 and one of the photoresistors 291 or 294 during a longer time, because it is jammed, the potential of the output of the Schmitt-trigger 325 is zero during a longer time, whereby the capacitor 329 will be charged via the resistor 327 and therefore the potential of the base of the transistor 328 decreases and the transistor becomes nonconductive. By this the further transport of sheets to the sorting apparatus is interrupted, e.g., by switching off the copying apparatus coupled to the sorting device.

The signals DOORSRT (sorting-up) and RESET are both generated by actuating switch 184, the first signal by actuating this switch for a relatively short time period e.g., no longer than one second, the second signal by actuating switch 184 for a time period longer than one second. In the rest position one of the open contacts of switch 184 (see FIG. 14) is connected to the terminal O V of the DC-source, the second contact being connected to the terminal +5V via a first resistor 331 and a second resistor 332. The input of a Schmitt-trigger 333 is connected to the connection line between the resistors 331 and 332, the output signal of said trigger corresponding to the signal DOORSRT.

The output of the Schmitt-trigger 333 is also connected to the input of an inverter 334, the output signal of which therefore corresponds to the signal $\overline{\text{DOORSRT}}$.

The operation is as follows:

In the rest position the input of the Schmitt-trigger 333 is one, and therefore its output signal is zero. By closing switch 184 the potential of the input is decreased, to the signal zero, thereby generating a positive pulse in the output, the pulse width being dependent on the time that the switch 184 is closed. This pulse is the signal DOORSRT and inverted it is the signal $\overline{\text{DOORSRT}}$.

The output of the Schmitt-trigger 333 is connected to a terminal of a capacitor 337 via a resistor 336, the other terminal of which capacitor being connected to the terminal +5V of the DC-source. Besides the output of the Schmitt-trigger is also connected to the base of a transistor 338, the collector of which being connected to the terminal +5V and the emitter to the signal line of the signal RESET. As will become clear the following description, the signal RESET is only used as an inverted signal, and therefore the emitter of the transistor 338 is connected to the input of an inverter 339, the output signal of which corresponds to the signal $\overline{\text{RESET}}$.

In the rest position the switch 184 is open and the output signal of the Schmitt-trigger is zero, so that the capacitor 337 is charged. As soon as the switch 184 is closed, the output signal of the Schmitt-trigger becomes one, and the capacitor 337 starts to discharge via the resistor 336, thereby increasing the potential of the base of the transistor 338. If the switch 184 is opened again very quickly, the capacitor is not discharge enough to make the transistor 338 conductive. However, if the switch is closed for a longer time, the potential at the base of the transistor 338 can increase sufficiently so that the latter becomes conductive, i.e., the emitter signal becomes one, or the output signal of the inverter 339 becomes zero. This is the signal $\overline{\text{RESET}}$.

Each cam shaft controlling the movement of the bins, is coupled to a stepping motor and is provided with a recess which in a defined orientation or position of the cam shaft actuates a microswitch having two change-contacts. The defined position of the left cam shaft is chosen in such a way that in this position a copy sheet transported in the sorting apparatus will be received by the undermost bin of the left sorting box, i.e., the lowest but one bin is moved to the extreme right position. In the right sorting box the position is chosen in such a way that the uppermost bin is moved to the extreme left position.

The left cam shaft cooperates with a micro-switch 341 having a mother contact which is connected to the terminal O V of the DC-source and to two change-contacts 341A and 341B. The contact 341A is connected to the input 346S of a RS-flipflop 346 via a resistor 342 and to the terminal +5V via a resistor 343. The contact 341B is connected to the input 346R of the flipflop 346 via a resistor 344 and to the terminal +5V via a resistor 345. The flipflop 346 is in the known manner comprised of two NAND gates 347 and 348 each having two inputs, the output of the NAND gate 347 being connected to one of the inputs of the NAND gate 348 and vice-versa. The output signal 346Q of the flipflop 346 becomes one if the input signal 346R becomes zero and remains one until the input signal 346S of the flipflop 346 becomes zero, whereby the output signal 346Q becomes zero.

As long as the recess in the cam shaft does not cooperate with the micro-switch 341 the contact 341B is closed, the input signal 346R of the flipflop 346 being low or zero, and the input signal 346S being high or one. As soon as the recess in the cam shaft cooperates with the micro-switch 341, i.e., the left cam shaft is in the end position, the input signal 346S of the flipflop 346 becomes low or zero, whereas the input signal 346R becomes high or one. As long as the left cam shaft is not in the end position, the output signal 346Q of the flipflop 346 is one. As soon as the left cam shaft reaches the end position the output signal 346Q of the flipflop 346 becomes zero and remains zero until the left cam shaft leaves the end position.

The right cam shaft cooperates with a micro-switch 351 having a mother contact and two change-contacts 351A and 351B, the contact 351B being closed whenn the recess does not cooperate with the micro-switch 351.

Further, the micro-switch 351 is in the same way as the micro-switch 341 connected to a RS-flipflop 356 via resistors 352, 353, 354 and 355 said flipflop comprising two NAND gates 357, 358 each having two inputs, except that the contact 351A is connection to the input 356S and the contact 351B is connected to the input 356R of the flipflop 356.

This means that the output signal 356Q of the flipflop 356 becomes one when the right cam shaft is in the end position, and becomes zero when the right cam shaft is not in the end position.

The output 356Q of the flipflop 356 is connected to one input of a NAND gate 361 having two inputs, the other input being connected to the signal generator of the signal SM. As already mentioned, the signal SM is zero when the left stepping motor is activated, and one when the right stepping motor is activated. Therefore the output signal of the NAND gate 361 becomes only when the right stepping motor is activated and the right cam shaft is in the end position.

The output 346Q of the flipflop 346 is connected to one input of a NAND gate 362 having two inputs, the other input being connected to the output of the NAND gate 361. The output of the NAND -gate 362 is connected to one terminal of a capacitor 363, the other terminal of this capacitor being connected to a Schmitt-trigger 364 and, via a resistor 365, to the terminal O V of the DC-source.

The operation is as follows:

Starting from the situation that the output signal of the NAND gate 362 is one and becomes zero, the input signal of the Schmitt-trigger 364 becomes a sharp negative pulse, which has no effect. The output signal of the Schmitt-trigger 364 remains one. If the output signal becomes again one the input signal of the Schmitt-trigger 364 becomes a positive sharp pulse which is converted by the Schmitt-trigger into a rectangular negative pulse. This signal is the signal $\overline{\text{EINDST}}$.

From the foregoing it becomes clear that it is important to know when the output signal of the NAND gate 362 is changing from zero to one. If the left stepping motor is in operation, the signal SM is zero, and therefore the output signal of the NAND gate 361 is one, whether the output signal 356Q of the flipflop 356 is zero or one. As long as the left cam shaft is not in the end position, the output signal 346Q of the flipflop 346 is one, and therefore the output signal of the NAND gate 362 is zero. As the left cam shaft reaches the end position, the output signal 346Q of the flipflop 346 becomes zero, and therefore the output signal of the NAND gate 362 becomes one.

If the right stepping motor becomes operative, the signal SM becomes one, and, as will become clear from the following description, since the left cam shaft is not in the end position at that moment, and can not be rotated anymore, the output signal 346Q of the flipflop 346 is one. As long as the right cam shaft is not in the end position the output signal 356Q of the flipflop 356 is zero and therefore the output signal of the NAND gate 361 is one and the output signal of the NAND gate 362 is zero. As the right cam shaft reaches the end position, the output signal 356Q becomes one, whereby the output signal of the NAND gate 361 becomes zero and the output signal of the NAND gate 362 becomes one.

It must be noted that the signal $\overline{\text{EINDST}}$ is only generated at the moment that the left or the right cam shaft reaches its end position and is not maintained during the time that the respective cam shafts are in this position.

The switches 183 (sorting method B) and 182 (sorting method A). are mechanically interconnected in such a way that by closing switch 183 switch 182 is opened and vice-versa. The contact 183B of switch 183 (see FIG. 16) is connected to the terminal O V, whereas the other contact 183C is connected to the terminal +5V via resistors 371 and 372, and to a Schmitt-trigger 373 via resistor 371. The contacts of switch 183 are closed if the latter is actuated, i.e., if sorting method B is chosen, and opened if switch 182 is actuated, i.e., if sorting method A is chosen.

If sorting method A is chosen, the input signal of the Schmitt-trigger has a potential of +5V or is one, and therefore its output signal is zero, corresponding to the signal $\overline{B}$, being identical to the signal A. If sorting method B is chosen, the contacts of switch 183 are closed and therefore the potential of the input of the Schmitt-trigger 373 is reduced and becomes the value zero, thereby rendering its output signal one, corresponding to the signal B, being identical to the signal $\overline{A}$.

Figure 17:
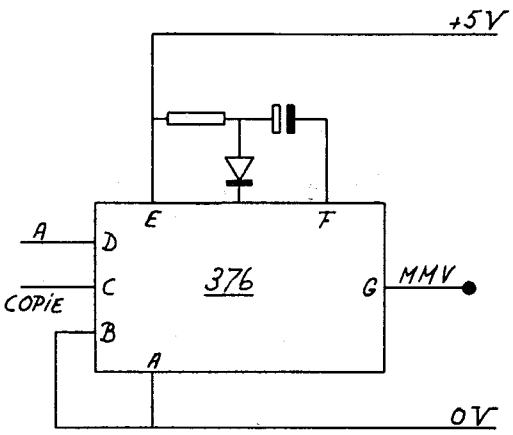
FIG. 17 is a diagram of the electric circuit of the signal generator for the signal MMV.

The signal B is inverted by means of a NAND gate 374 having one input and the output signal of this gate corresponds to provide the signal A. The signals A and COPIE are combined to a signal MMV by means of an electric circuit shown in FIG. 17. The main component of the generator of the signal MMV is formed by a retriggable monostable multivibrator 376, which in the disclosed embodiment is formed by an integrated circuit of the type TTL 74123 as sold by Texas Instruments.

Figure 16:
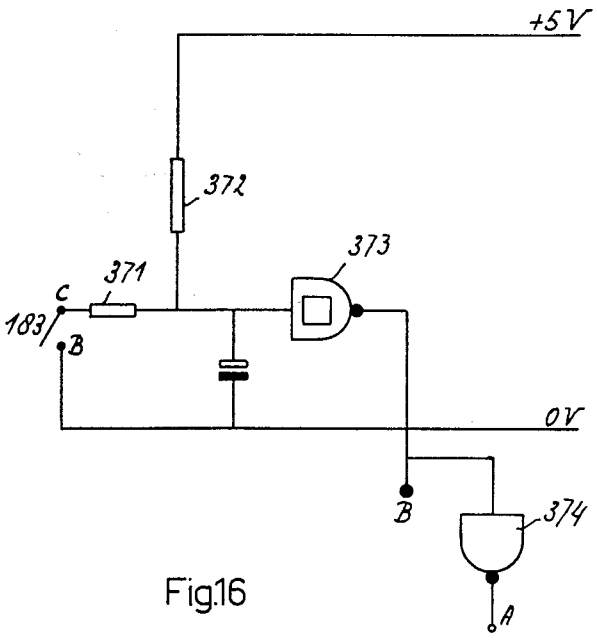
FIG. 16 is a diagram of the electric circuit of the signal generator for the signals A and B.

The inputs 376A and B corresponding to the pins 8 and 9 of the integrated circuit are connected to the terminal O V of the DC-source, the input 376C corresponding to the pin 10 is connected to the generator of the signal COPIE (see FIG. 13) and the input 376D corresponding to the pin 11 to the generator of the signal A corresponding to sorting method A (see FIG. 16).

If sorting method B is choosen the input signal 376D is always zero, so that also the output signal 376G of the multivibrator is always zero.

If sorting method A is choosen the input signal 376D is always one, so that every time a signal COPIE is present in the input 376C, the output signal 376G becomes a rectangular pulse, the width thereof being determined by the values of the components of the external RC-circuit connected to the inputs 376E and F of the monostable multivibrator. These values are choosen in such a way that if the signals COPIE are repeated with a sufficient frequency, the output signal 376G has not been zero at the moment the next signal COPIE appears, i.e., as long as the signals COPIE are generated with a sufficient frequency in the input 376C, the output signal 376G remains one.

The external RC-circuit is adapted to the type of apparatus feeding the sheets to be sorted, and in case of a copying apparatus, it is defined by the copying rate, i.e., the number of copies of the same original that can be produced in one minute. In the case of, e.g., a copying apparatus having a copying rate of 60 copies/minute, at every signal COPIE the multivibrator generates a pulse lasting a bit longer than one second.

From the foregoing it becomes clear that by choosing the sorting method B the output signal 376G is always zero, whereas by choosing sorting method A, the output signal 376G is one as long as copies of the same original are transported into a bin of the sorting apparatus. The output signal 376G is the signal MMV.

Figure 18:
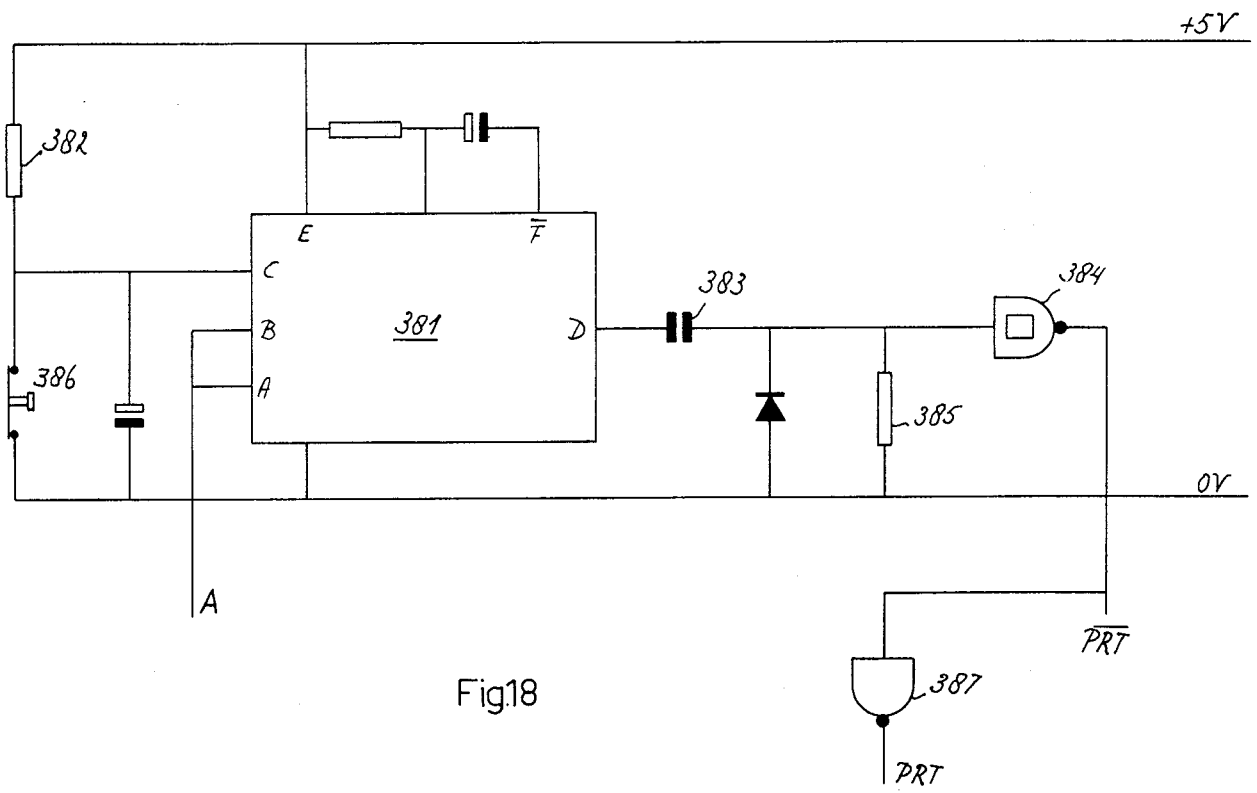
FIG. 18 is a diagram of the electric circuit of the signal generator for the signal PRT.

The last external signal necessary for the operation of the sorting apparatus is the signal PRT, or the inversed signal $\overline{\text{PRT}}$. The main component of the generator of the signal $\overline{\text{PRT}}$ is formed by a monostable multivibrator 381 (see FIG. 18) which, in the described embodiment, is formed by an integrated circuit of the type TTL 74121 as sold by Texas Instruments, the inputs 381A and B corresponding to the pins 3 and 4 being connected to the output of the generator of the signal A.

The input 381C corresponding to the pin 5 of the integrated circuit is connected to the terminal +5V via a resistor 382, and to the terminal O V via the normally closed contacts of the print switch 386 of the copying apparatus supplying copies to the sorting apparatus. Therefore, the input signal 381C is normally zero. As long as sorting method A is choosen, the output signal 381D corresponding to pin 1 of the multivibrator is one, whatever being the input signal 381C. The output 381D is connected to a capacitor 383, which capacitor is also connected to the input of a Schmitt-trigger 384 having an inverted output, and via a resistor 385, to the terminal O V. As long as the output signal 381D is one, the output signal of the Schmitt-trigger 384 is also one.

If sorting method B is chosen and the print knob of the copying apparatus is actuated, the contacts of the print knob 386 are opened and the input signal 381C becomes one, whereby the output signal 381D temporarily becomes zero (the pulse width is controlled by an external RC-circuit). As soon as the output signal 381D again becomes one, a positive pulse is formed in the input of the Schmitt-trigger, the output signal of which becomes temporarily zero (see also FIG. 15).

The output signal of the Schmitt-trigger is the signal $\overline{PRT}$, i.e., the signal is high or one as long as the print knob is not actuated, and becomes temporarily low or zero if sorting method B is choosen and the print knob is actuated.

The output of the Schmitt-trigger 384 is connected to an inverter or NAND gate 387, the output signal of which consequently corresponds to the signal PRT.

The above described generators of the signals COPIE, DOORSRT, $\overline{RESET}$, PRT, or $\overline{PRT}$, EINDST, B, A and MMV from the external signals which are used in the control circuit which will now be described in greater detail.

The control circuit (see FIG. 19) actually is built up out of a number of signal generators, which can be formed by NAND gates as for the signals $\overline{SMA}$, $\overline{SMB}$, SM-PULS, $\overline{TP}$ or TP, $\overline{14ST}$, RGH, RTL, $\overline{NS}$, $\overline{15ST}$ and BO, by flipflops as for the signals Q10, SM, $\overline{Q12}$, Q13 and $\overline{RST}$, by an oscillator for the signals $\overline{OSC}$, by a counter for the signals Q1, Q3, Q5 and Q7, by a memory device for the signals Q2, Q4, Q6 and Q8 and by a comparative circuit for the signal $\overline{VGL}$. These signal generators will now be described.

The oscillator 391 is formed by a Schmitt-trigger 392 having two inputs and an inverted output. The input 392*b* of the Schmitt-trigger is connected to ground via a capacitor 393, and to the output via a potentiometer 394, which output is connected to the terminal +5V of the DC-source via a resistor 395.

The operation of the oscillator is as follows:

As long as the input signal 392*a* of the Schmitt-trigger 392, which is connected to the generator of the signal BO, is zero, the output signal of the gate 392 is high or one, thereby charging the capacitor 393, whereby the input signal 392*b* becomes high or one.

As soon as the signal BO becomes one, the output signal of the gate 392 becomes zero, thereby discharging the capacitor 393, whereupon the input signal 392*b* becomes zero, whereby the output signal becomes again one, whereupon the capacitor 393 is charged again and the input signal 392*b* becomes one again. By adjusting the potentiometer the pulse width of the oscillator can be controlled.

As soon as the signal BO becomes zero again, the oscillator is blocked. The oscillator generates the signal $\overline{OSC}$.

In the disclosed embodiment, the counter 401 is formed by an integrated circuit of the type TTL 7493 as sold by Texas Instruments, which circuit is actually comprised of four T-flip-flops the Q1-output thereof being connected to the T2-input, whereby a binary counter is formed having sixteen positions.

Since the T-input is an inverted input, the counter reacts on the descending edge of a pulse. The counter can be activated and reset by means of the inputs S2 and S4 which are interconnected in the disclosed embodiment.

As long as the input signals S2 and S4 are zero, the counter 401 is able to count pulses, but as soon as the input signals S2 and S4 become one, the counter is reset and blocked until these input signals become zero again.

The function table is as follows:

| Pulse No. | $Q_1$ | $Q_3$ | $Q_5$ | $Q_7$ |
|---|---|---|---|---|
| 0 | 0 | 0 | 0 | 0 |
| 1 | 1 | 0 | 0 | 0 |
| 2 | 0 | 1 | 0 | 0 |
| 3 | 1 | 1 | 0 | 0 |
| 4 | 0 | 0 | 1 | 0 |
| . | . | . | . | . |
| 8 | 0 | 0 | 0 | 1 |
| . | . | . | . | . |
| 12 | 0 | 0 | 1 | 1 |
| 13 | 1 | 0 | 1 | 1 |
| 14 | 0 | 1 | 1 | 1 |
| 15 | 1 | 1 | 1 | 1 |

The inputs S2 and S4 are connected to the generator of the signal RTL, whereas the input T1 is connected to the generator of the signal TP.

In the disclosed embodiment the memory device 402 is formed by an integrated circuit of the type TTL 7475 as sold by Texas Instruments, which circuit is composed of four flipflops, the inputs D1, D2, D3 and D4 being connected to the outputs Q1, Q3, Q5 and Q7 respectively of the counter.

The inputs T1 and T2 of the trigger are connected to the generator of the signal RGH.

The operation is such that as long as the input signals T1 and T2 are one, the signal in the output Q2*n*+1 of the memory 402 corresponds to the inverted output singal Q2*n* of the counter. The information remains present, after the output signals T1 and T2 have become zero, and the output Q2*n*+1 of the memory device 402 adapt again the information of the counter 401 at the moment that the input signals T1 and T2 become one again. If at that moment the counter is reset, then the memory device is also reset.

In the disclosed embodiment the comparative circuit 403 is formed by four exclusive OR gates 404, 405, 406 and 407, each having two inputs, the inputs 404*a*, 405*a*, 406*a* and 407*a* of the gates 404, 405, 406 and 407 respectively being connected to the outputs Q7 Q5, Q3 and Q1 respectively of the counter 401 and the inputs 404*b*, 405*b*, 406*b*, and 407*b* to the outputs Q8, Q6, Q4 and Q2 respectively of the memory device 402. The outputs of the gates 404, 405, 406 and 407 are connected to the four inputs of a NAND gate 408. The output signal of each exclusive OR gate is one if the two input signals are different, i.e., are input signal is one and the other zero, and zero if the two input signals are equal, either both one or both zero.

Because the output signal of the NAND gate 408 is only zero if the four input signals are one, its output signal becomes zero only if the output signals Q1, Q3, Q5 and Q7 respectively correspond to the output signals Q2, Q4, Q6 and Q8 respectively. In each other situation the output signal of the NAND gate 408 is one. The output signal of the NAND gate 408 corresponds to the signal $\overline{VGL}$.

The outputs Q1, Q3, Q5 and Q7 of the counter 401 are connected respectively to the inputs of a NAND gate 409 having four inputs. The output signal of the NAND gate 409 is one as long as the output signals of the counter 401 correspond to a number under fifteen, and becomes zero as soon as each output signal Q1, Q3, Q5 and Q7 becomes one, i.e., the binary number fifteen is formed. The output signal of the NAND gate 409 corresponds to the signal $\overline{15ST}$.

The outputs Q3, Q5 and Q7 of the counter 401 are connected respectively to three inputs of a NAND gate 410 having four inputs, the fourth input being connected to the generator of the signal SM. As long as the left stepping motor is activated the signal SM is zero, thereby making the output signal of the gate 410 one. however, as soon as the right stepping motor is activated and the output signals Q3, Q5 and Q7 of the counter 401 form the binary number 14, the output signal of the gate 410 becomes zero. The output signal of the gate 410 corresponds to the signal $\overline{14ST}$.

The three inputs of a NAND gate 411 are connected to the generator of the signal $\overline{14ST}$, to the generator of the signal MMV and to the generator of the signal A respectively. The output signal of the NAND gate 411 is zero only if all its input signals are one, i.e., if sorting method A has been selected and the signal MMV is one, which happens as long as copies are being transported into the sorting apparatus, and these copies are not to be transported into the last bin. The output signal of the NAND gate 411 corresponds to the signal $\overline{SMA}$.

The three inputs of a NAND gate 412 are connected to the generator of the signal COPIE, to the generator of the signal B and to the generator of the signal $\overline{14ST}$ respectively. The output signal of the NAND gate 412 is only then zero if its three input signals are one, i.e., if a copy is being transported into a bin of the sorting apparatus, sorting method B has been selected, and the said copy will not be transported into the last bin. The output signal of the NAND gate 412 corresponds to the signal $\overline{SMB}$.

The three inputs of a NAND gate 413 are connected to the output of the NAND gate 411 generating the signal $\overline{SMA}$, to the output of the NAND gate 412 generating the signal $\overline{SMB}$ and to the output of the oscillator generating the signal $\overline{OSC}$ respectively. Because $A=\overline{B}$, one of the signals $\overline{SMA}$ or $\overline{SMB}$ is one. In the case where the oscillator is not actuated, the signal $\overline{OSC}$ is also one. The gate 413 then only reacts on the signal $\overline{SMA}$ if sorting method B is selected and only on the signal $\overline{SMB}$ is sorting method A is selected.

Since the oscillator is only operative at a moment when there are no copies being transported into the sorting apparatus, and therefore the signals $\overline{SMA}$ and $\overline{SMB}$ are both one, the gate 413 reacts on the signal of the oscillator. The output signal of the gate 413 corresponds to the signal SM-PULS.

The three inputs of a NAND gate 414 are connected to the output of the NAND gate 413 generating the signal SM-PULS, to the output of the NAND gate 409 generating the signal $\overline{15ST}$ and to the output Q12 of a flipflop 423 respectively. The signal SM-PULS is only inverted by the NAND gate 414 if the two other input signals are one, i.e., the signal SM-PULS is blocked if the counter 401 has reached the number 15 or if the signal $\overline{PRT}$ has not been followed by a signal $\overline{EINDST}$.

The output signal of the gate 414 corresponds to the signal $\overline{TP}$. The output of the gate 414 is connected to the input of an inverter 415, the output signal of which corresponds to the signal TP, which signal is used as the input signal of the counter 401.

The RS flipfops used are of the type composed of two NAND gates, having each at least two inputs, one of these inputs of the first gate being connected to the output of the second gate and vice versa. With this type of flipflops the input signals of the two NAND gates may not be zero at the same time, since otherwise the information contained in one of the outputs gets lost because both output signals become one. In the rest position the input signals of the flipflops are normally one.

In case such a flipflop is comprised of two NAND gates each having two inputs, the output signal of the first NAND gate will become one and the output signal of the second NAND gate zero if the input signal of the free input of the first NAND gate is temporarily zero, and this situation will be maintained until the input signal of the free input of the second NAND gate becomes zero, whereupon the reversed situation occurs. In case one NAND gate has or both NAND gates have more than one free input, the output signal of the one NAND gate will become one, if one of its free input signals become zero, and again zero, if one of the free input signals of the other NAND gate becomes zero.

In the control circuit there are five RS flipflops of this type. The flipflop 416 is formed by two NAND gates 417 and 418 each having two inputs. The input 417*a* of the NAND gate 417 is connected to the output of a NAND gate 419, the input 419*a* of which is connected to the generator of the signal SM. This signal is zero if the left stepping motor is activated and one if the right stepping motor is activated. The input 419*b* of the gate 419 is connected to the generator of the signal DOORSRT.

The output signal of the NAND gate 419 is zero if the input signals 419*a* and 419*b* both are one, i.e., is the right stepping motor if activated and the signal DOORSRT is present. In all other situations the output signal of the NAND gate 419 is one. This means that the output signal Q10 of flipflop 416 becomes zero if the right stepping motor is activated and the signal DOORSRT is present.

The input 418*b* of the gate 418 is connected to the generator of the signal $\overline{RESET}$.

The operation of the flipflop 416 is as follows.

Starting from the situation that the sorting device is completely reset, i.e., the signal $\overline{RESET}$ has become temporarily zero, and therefore the output signal Q10 is one as long as the left stepping motor is activated, i.e., the right sorting box is not used, the output signal Q10 remains one, whether or not the switch 184 has been activated for the sorting up mode.

As soon as the right sorting box is used and therefore the signal SM becomes one, the flipflop 416 can be reset by means of the signal DOORSRT, whereby the output signal Q10 becomes zero until the signal $\overline{RESET}$ becomes temporarily zero again. The resetting of the flipflop 416 is obtained by means of the signal $\overline{RESET}$, which is generated by actuating for a longer time the switch 184. During setting of the flipflop 416, the signal DOORSRT is generated first, whereby in case the right stepping motor is activated the flipflop 416 is reset, thereby making the signal Q10 zero, and thereupon the signal $\overline{RESET}$ is generated whereby the signal Q10 becomes one again, whatever being the input signal 417*a* of the gate 417.

The flipflop 420 is formed by two NAND gates 421 and 422, having three inputs.

The output Q11 of the flipflop 420 is formed by the output of the NAND gate 421, the inputs 421*a* and 421*b* thereof forming the setting inputs. The input 421*a* is connected to the ouput Q10 of the flipflop 416, whereby the flipflop 420 is set via this input if the flipflop 416 is reset. The input 421*b* is connected to the output of the NAND gate 409 generating the signal $\overline{15ST}$, whereby the flipflop 420 is set via this input if the signal $\overline{15ST}$ becomes zero. The input 422*b* of the gate 422 is connected to the generator of the signal $\overline{PRT}$, whereby the flipflop 420 is reset via this input if the print knob of the copying apparatus coupled to the sorting apparatus is actuated. The input 422*c* is connected to the output Q14 of the flipflop 429, generating the signal $\overline{RST}$, whereby the flipflop 420 is reset via this input if the flipflop 429 is set. The output signal Q11 of the flipflop 420 corresponds to the signal SM, or in other words in the set position the right stepping motor is activated and in the reset position the left stepping motor is activated.

The flipflop 423 is formed by two NAND gates 424 and 425 each having two inputs. The output Q12 of the flipflop 423 is formed by the output of the NAND gate 425, the input 425*b* thereof being the set input. The input 425*b* is connected to the generator of the signal $\overline{EINDST}$, whereby the flipflop 423 is set if this signal temporarily becomes zero.

The input 424*a* of the gate 424 is the reset input and is connected to the generator of the signal $\overline{PRT}$, whereby the flipflop 423 is reset each time the print knob of the copying apparatus coupled to the sorting apparatus is actuated.

The flipflop 426 is formed by two NAND gates 427 and 428 each having two inputs. The output Q13 of the flipflop 426 corresponds to the output of the NAND gate 428, the input 428*b* thereof forming the set input which is connected to the output of the comparative circuit. The flipflop 426 is set each time the signal $\overline{VGL}$ temporarily becomes zero, or in other words each time the binary number of the counter corresponds to the binary number of the memory device.

The input 427*a* of the gate 427 is the reset input of the flipflop 426 and is connected to the generator of the signal $\overline{PRT}$, the flipflop 426 being reset each time the print knob of the copying apparatus coupled to the sorting apparatus is actuated.

The flipflop 429 is formed by two NAND gates 430 and 431, the NAND gate 430 having two inputs and the NAND gate 431 having three inputs. The output Q14 of the flipflop 429 corresponds to the output of the NAND gate 430, the input 430*a* thereof being the reset input. This input 430*a* is connected to the generator of the signal $\overline{EINDST}$, the flipflop 429 being reset each time the signal $\overline{EINDST}$ becomes zero. The input 431*b* of the NAND gate 431 is connected to the output of a NAND gate 432 generating the signal $\overline{NS}$, the flipflop 429 being set via this input each time the signal $\overline{NS}$ becomes zero, i.e., each time the binary number in the memory device 402 corresponds to zero and the signal PRT becomes one which is equal to actuating the already mentioned print knob. The input 431*c* of the NAND gate 431 is connected to the generator of the signal $\overline{RESET}$, the flipflop 429 being set via this input if the signal $\overline{RESET}$ becomes zero. The output signal Q14 of the flipflop 429 corresponds to the signal $\overline{RST}$.

The outputs Q2, Q4, Q6 and Q8 of the memory device 402 are connected respectively to the four inputs of a NAND gate 432 having five inputs, the fifth input being connected to the generator of the signal PRT. As long as the signal PRT is zero, the output signal of the NAND gate 432 is one. If the signal PRT becomes one as a result of the actuating of the print knob of the copying apparatus coupled to the sorting apparatus, and the signals Q2, Q4, Q6 and Q8 of the memory device 402 correspond to the binary number zero, the output signal of the NAND gate 432 becomes zero. The output signal of the NAND gate 432 corresponds to the signal $\overline{NS}$.

The three inputs of a NAND gate 433 are connected to the output of the NAND gate 409 generating the signal $\overline{15ST}$, to the output of the flipflop 429 generating the signal $\overline{RST}$ and to the output of the flipflop 426 generating the signal Q13 respectively. The output signal of the NAND gate 433 is only zero, if its three input signals are one, i.e., the counter 401 contains a binary number under fifteen, the flipflop 429 is reset which means that the signal $\overline{EINDST}$ has been generated, and the flipflop 426 is set which means that the binary number of the counter corresponds to the binary number of the memory device. The output signal of the NAND gate 433 corresponds to the signal BO.

The two inputs of a NAND gate 434 are connected to the generator of the signal $\overline{DOORSRT}$ and to the output of the flipflop 429, generating the signal $\overline{RST}$ respectively. The output signal of the NAND gate 434 is only zero if its two input signals are one i.e., the switch sorting up is not actuated and the flipflop 429 is reset which means that the signal $\overline{EINDST}$ is generated. The output signal of the NAND gate 434 corresponds to the signal RGH.

Since the leading or increasing edge of this signal is used, it is important to know when the signal RGH is changing from zero to one. Starting from the above mentioned situation this happens if the signal DOORSRT is generated, or the signal $\overline{RESET}$ is generated, or the signal $\overline{NS}$ is generated.

The three inputs of a NAND gate 435 are connected to the output of the flipflop 429 generating the signal $\overline{RST}$, to the generator of the signal $\overline{EINDST}$ and to the generator of the signal $\overline{PRT}$ respectively. The output signal of the NAND gate 435 is only zero if its three input signals are one, i.e., the flipflop 429 is reset which means that the signal $\overline{EINDST}$ has been generated, the signal $\overline{EINDST}$ is not or no longer zero and the print knob is not actuated. The output signal of the NAND gate 435 corresponds to the signal RTL.

Figure 19:
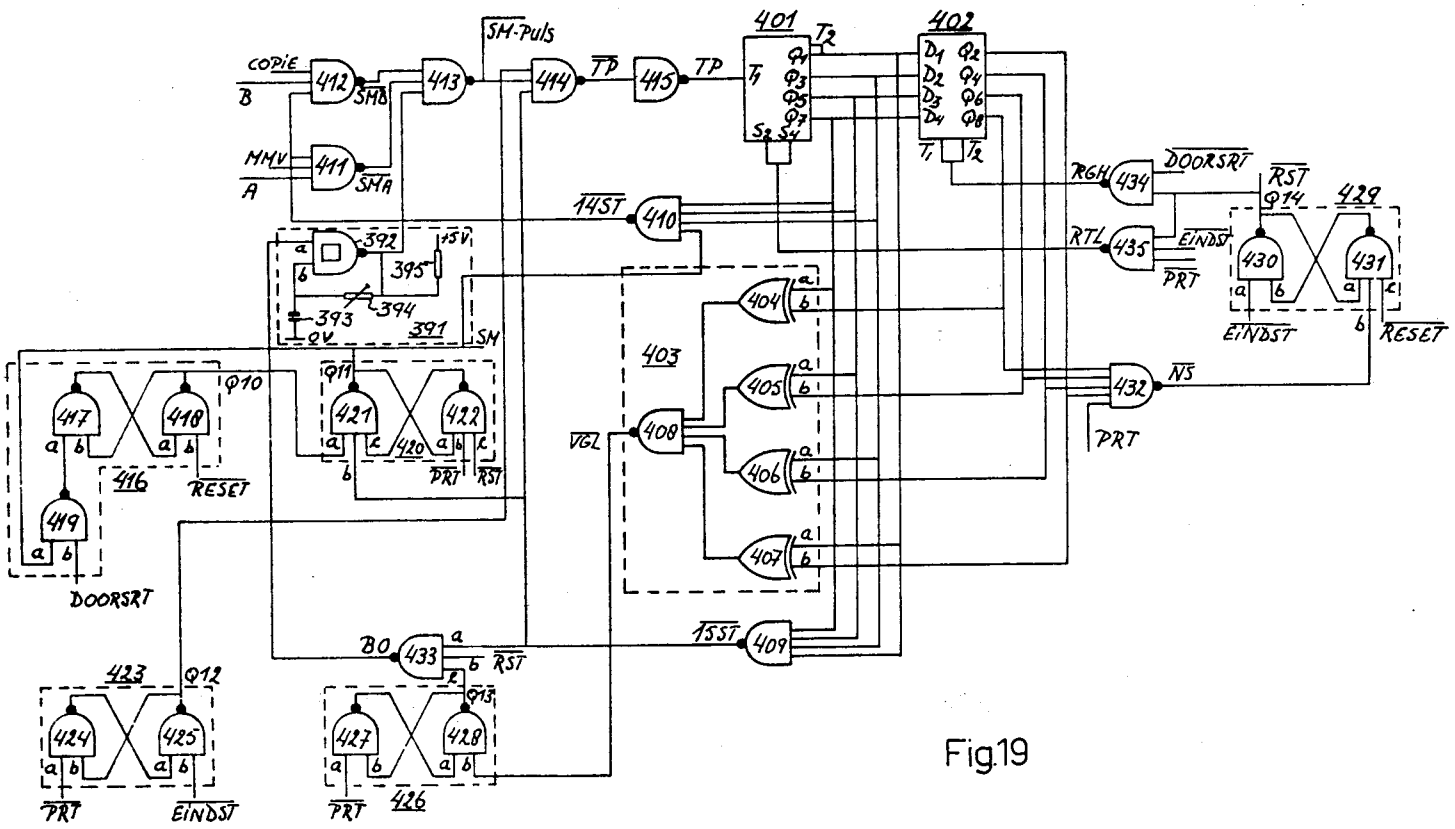
FIG. 19 is a diagram of the electric control circuit.
Figure 20:
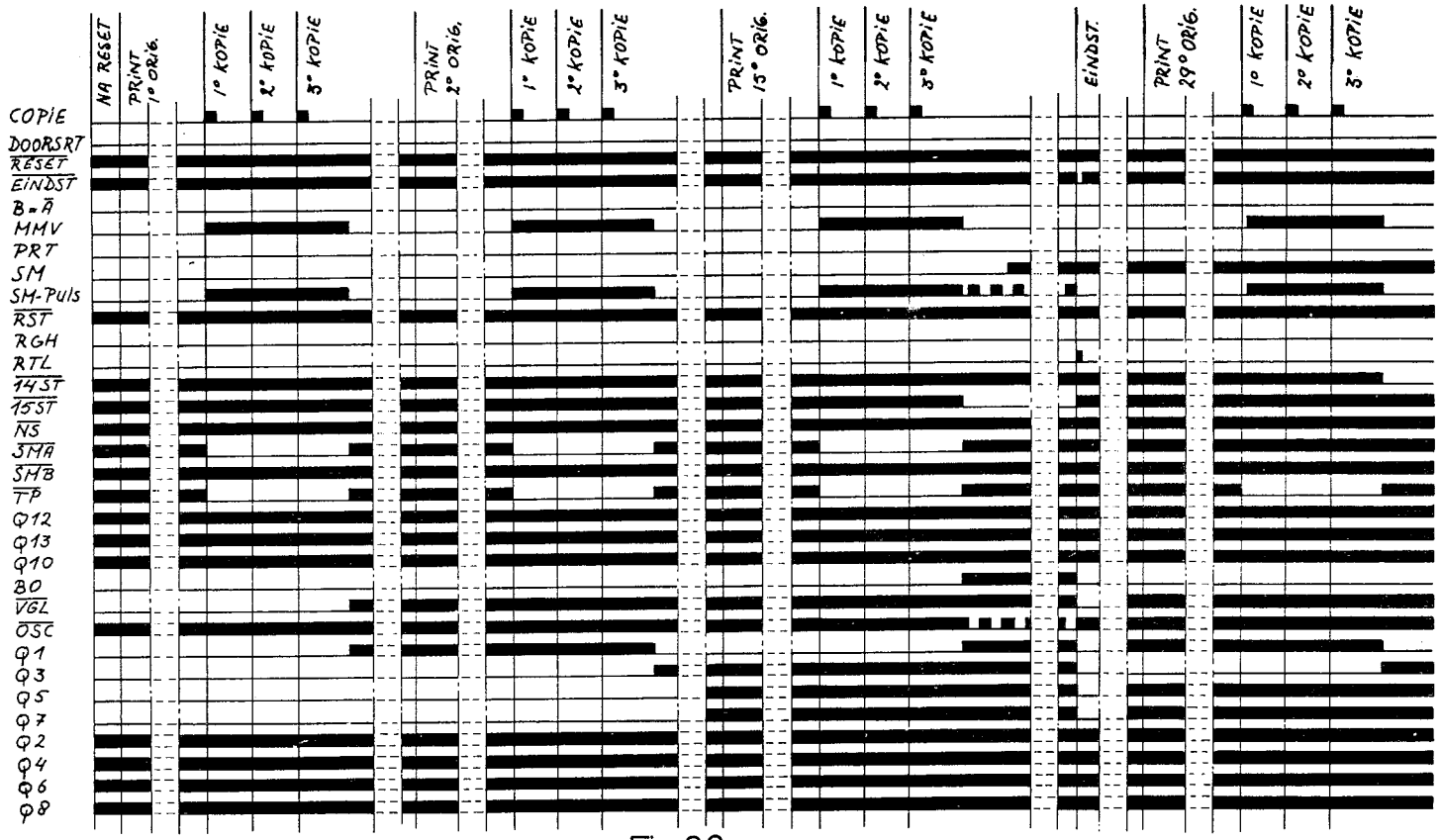
FIG. 20 is a diagrammatic illustration of the signal values versus time in a case of sorting method A.

For a good understanding of the operation of the control circuit according to FIG. 19 reference is made of FIGS. 20 up to and including 23, wherein the changing from one to zero or vice versa of each signal that is important in the control circuit of FIG. 19, is represented as a function of the time and as a function of external signals. On the left side of each of the FIGS. 20 up to and including 23 the distinct signals are indicated, the first seven being external signals for the control circuit of FIG. 19. In the FIGS. 20–23 the various external actions of the signals are indicated by means of a vertical line, the nature of these actions being described above the FIGURE.

It must be noted that the horizontal axis is not a real time axis, but only an approximation, whereas at defined positions the horizontal axis is interrupted in order to indicate an undefined time lapse.

In FIG. 20 the operation of the control circuit of FIG. 19 is schematically represented in the case where sorting method A has been select. Starting from the situation that the sorting apparatus is in the zero position, i.e., the cam shaft of the left sorting box is in the end position, or in the position wherein the first copy is to be transported into the first bin, and the counter 401, the memory device 402 and the counter 311 are set on the binary number zero. In the control circuit represented in FIG. 19 the signals have the values represented in FIG. 20 at the location of "NA RESET". How this situation is achieved will become clear from the following description.

By actuating the print knob of the copying apparatus coupled to the sorting apparatus, no signal will change since by selecting sorting method A the signal will change since by selecting sorting method A the signal PRT is blocked. As soon as the first copy arrives into the sorting apparatus and is deposited into the first bin of the left sorting box, a signal COPIE is generated. This signal COPIE generates a signal with greater pulse width, i.e., the signal MMV, whereby the output signal of the gate 411 becomes zero, as a result of which the output signal of gate 413 becomes one and the output signal of the gate 414 zero. If more than one copy of the same original is produced, the second copy will be in the sorting apparatus and will generate a signal COPIE before the signal MMV changes to zero. Thereby the signal MMV is extended, the signals generated after the appearance of the first signal COPIE are maintained, i.e., the signal MMV is one, the signal SM-PULS one, the signal $\overline{SMA}$ zero and the signal $\overline{TP}$ zero.

In the diagram of FIG. 20 it is supported that three copies of the same original are to be produced. Upon generating the signal COPIE of the third and last copy, the signal MMV is changed from one to zero after a defined lapse of time, whereupon the signal $\overline{SMA}$ becomes one, the signal SM-PULS zero and the signal $\overline{TP}$ one. The changing to zero of the signal SM-PULS causes the stepping motor to turn through one step, or in other words, the next copy will be transported into the second bin. The changing to one of the signal $\overline{TP}$ causes the output signals Q1 of the counter 401 to change to one. Since the binary number present in counter 401 is now different from the binary number in the memory device 402 the output signal of the comparative circuit becomes one.

When thence a second original is put in the copying machine coupled to the sorting apparatus and the print knob is actuated, nothing will change until again the first copy arrives into the sorting apparatus and generates a signal COPIE. This causes the same changes of signals as in the case of the first original, i.e. the signal MMV becomes one, the signal $\overline{SMA}$ becomes zero, the signal SM-PULS becomes one and the signal $\overline{TP}$ becomes zero.

After the last copy of the second original is deposited into the sorting apparatus, the above cited signals are inverted, as a result of which the stepping motor is turned through one step and in the counter 401 the binary number two is set. At the next original the above mentioned operation is repeated, the stepping motor being turned through one step and in the counter 401 there is added one. This operation is continued in the same way until the fifteenth original. When the last copy of the fifteenth original is deposited into the fifteenth and thus last bin of the left sorting box, and after the signal MMV has become zero, the number fifteen will be set in the counter 401, whereby the output signal of the gate 409 becomes zero. As a result thereof the output signal of the gate 433 or the signal BO becomes one, and the oscillator becomes operative.

The oscillator pulses $\overline{OSC}$ are transmitted to the left stepping motor via the gate 413, whereby initially the left cam shaft is turned through a few steps, in order to free the transport path for the next copies. Since the output of the gate 409 is connected to one of the inputs of the gate 421 of the flipflop 420 the output signal Q11 of this flipflop becomes one or, in other words, the signal SM becomes one.

Since a delaying device is incorporated in the connection line between the output Q11 of the flipflop 420 and the converter 308, the right stepping motor is actuated after the left stepping motor has turned through a number of steps.

At the same time as the signal $\overline{15ST}$ becomes zero, the gate 414 is blocked, so that the oscillator pulses are is not transmitted to the counter 401. The right stepping motor now will start operation and will turn the cam shaft of the right sorting box until the latter reaches the position wherein the next copy will be transported into the first bin of the right sorting box, or the socalled end positin of the right cam shaft. Thereby the signal $\overline{EINDST}$ is generated whereby the output signal of the gate 435 becomes one, which resets the counter 401, in consequence whereof the output signal of the comparative circuit becomes zero and the output signal of the gate 409 become one, by which the output signal of the gate 433 become zero and the oscillator is blocked and the gate 414 is activated.

When now copies of a sixteenth original are transported into the sorting apparatus, the operation will be the same as described above with respect to the first and second original. A special situation occurs if the apparatus in this way is operated until the twentyninth original, which corresponds to the fourteen original to be sorted in the right sorting box.

After the transporting of the last copy of the twentyninth original the signal MMV has become zero and the counter 401 is set to the number 14, and, because the signal SM is one, the output signal of the gate 410 becomes zero, whereby the gate 411 as well as the gate 412 is blocked, as a result of which it is not possible to generate a signal SM-PULS. All copies of any further original will now be transported into the last and fifteenth bin of the right sorting box.

Figure 21:
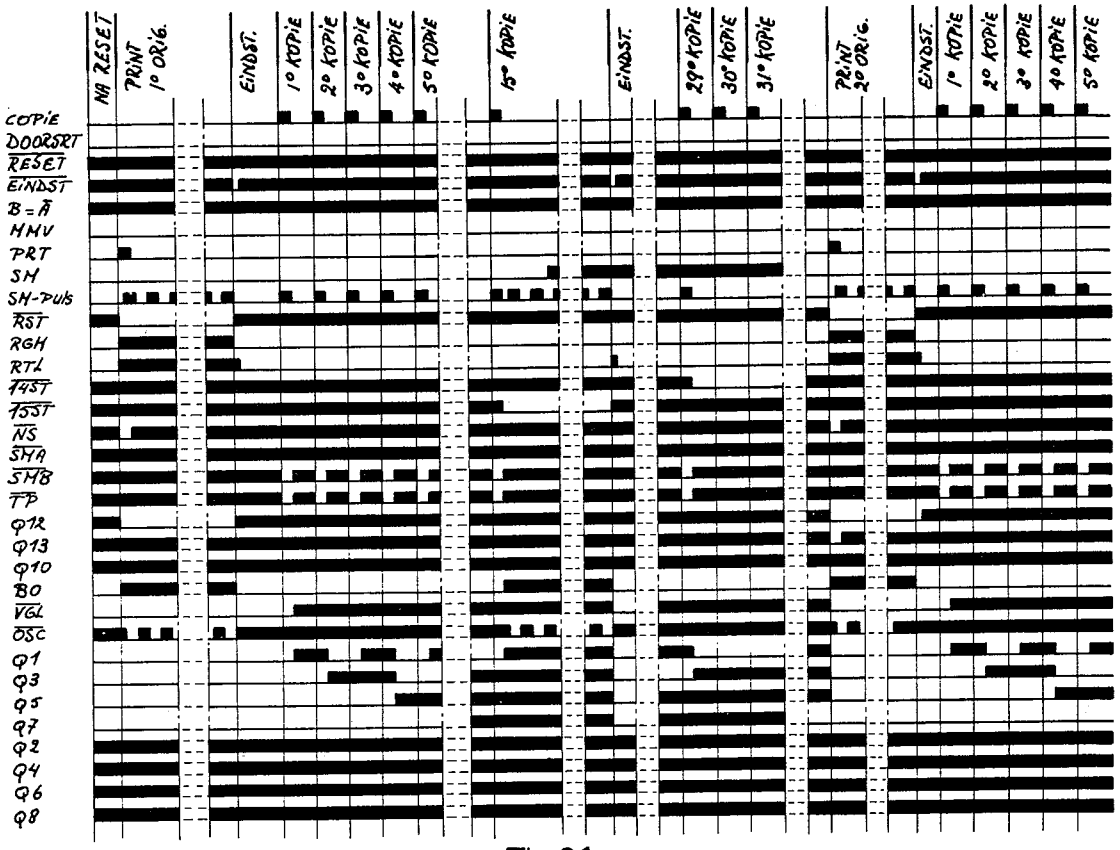
FIG. 21 is a diagrammatic illustration of the signal values versus time in a case of sorting method B.

In FIG. 21 the operation of the circuit of FIG. 19 is schematically represented in the case where sorting method B has been chosen. Once again the operation of the apparatus is started from the condition that the apparatus. is completely reset, i.e., the cam shaft of the left sorting box is in the end position or in other words, in the position wherein the next copy will be transported into the first bin, and the counter 401, the memory device 402 as well as the counter 311 are set on the binary number zero.

In the electric circuit represented in FIG. 19 the signals have the values represented in FIG. 21 at the location of "NA RESET". How this situation is achieved will be described hereinafter.

At the actuation of the print knob the signal PRT will be generated since the sorting method B has been selected. As a result the output Q12 of flipflop 423 becomes zero and the output of the gate 432 becomes also zero because the memory device is set on the binary number zero and therefore its four outputs signals are one. The output signal Q13 does not become zero because the output signal of the comparative circuit is zero at that moment. As the signal $\overline{NS}$ becomes zero, the signal $\overline{RST}$ becomes also zero whereby the signal BO becomes one and the oscillator is started. As a result the left stepping motor starts turning. But the signals SM-PULS are not transmitted to the counter 401 because the gate 414 is blocked since the signal Q12 is zero. As soon as the left cam shaft has reached its end position the signal $\overline{EINDST}$ is generated whereby the flipflop 429 is reset and therefore the signal $\overline{RST}$ becomes one again, thereby stopping the oscillator and resetting the flipflop 423 thus making the signal Q12 one which opens the gate 414. This all happens within the time needed to make the first copy, so that still no signal COPIE has been generated. As thereupon the first copy is transported into the first bin a signal COPIE is generated and since sorting method B has been selected, the signal $\overline{SMB}$ becomes zero, whereas signal SM-PULS becomes one and the signal $\overline{TP}$ zero. As soon as the first copy is completely in the bin the cited signals are inverted, whereby the stepping motor turns through one step and the counter 401 is set on the binary number one.

The next copy will be transported into the second bin. Because the counter 401 is set on the number one, the number of the counter 401 is different from the number of the memory device 402, whereby the signal $\overline{VGL}$ becomes one. At the transporting of the second copy into the second bin the above cited operation is repeated, the counter being set to two and the signal $\overline{VGL}$ being unchanged. This is repeated until the fifteenth copy, in case so many copies are made, whereupon the counter is set to the binary number fifteen whereby the signal $\overline{15ST}$ becomes zero and the signal BO one, thus starting the oscillator. At the same time as the oscillator is started the gate 414 is blocked because the signal $\overline{15ST}$ has become zero, whereas the signal SM becomes one because the input signal 421*b* of the flipflop 420 becomes one. Since the signal SM is transmitted with delaying time to the converter 308, the first oscillator pulses will be transmitted to the stepping motor of the left cam shaft, whereby the latter still will turn over a few steps and will stop in a position whereby the transport path is free of guide organs at which moment the right stepping motor is activated because the signal SM has become one, whereupon this motor turnes over a number of steps until the right cam shaft reaches the end position. By reaching the end position the signal $\overline{EINDST}$ is generated, whereby the output signal of the gate 435 becomes one and the counter 401 is reset. Thereby the signal $\overline{15ST}$ becomes again one and the oscillator stops. The sixteenth copy will now be transported into the first bin of the right sorting box. After the twentyninth copy is transported into the twentyninth bin, in case so many copies are made, the counter 401 reaches the number fourteen and because the right stepping motor is activated and the signal SM is one, whereby the signal $\overline{14ST}$ becomes zero thus blocking the gates 411 and 412. The thirtieth copy is nevertheless transported into the thirtieth bin, but the right cam shaft cannot be rotated further because the signal $\overline{SMB}$ remains always one. All the following copies will thus be transported into the thirtieth bin.

When thereupon a new original is put in the copying apparatus and the print knob is actuated and it is supposed that seven copies of the first original have previously been made, we have the situation as represented in FIG. 21 left with respect to "print 2nd original". By actuating the print knob the signal PRT is generated again, whereby the signal SM becomes zero, the signal Q12 becomes zero thus blocking the gate 414, the signal Q13 becomes zero because the signal $\overline{VGL}$ is one and whereby the signal $\overline{RST}$ becomes zero because the signal $\overline{NS}$ has become zero.

The signal BO becomes one and the oscillator starts operation. The pulses of the oscillator are transmitted to the left stepping motor, but not to the counter 401. At the same time the counter 401 is reset via the gate 435 by the signal $\overline{PRT}$, whereas by the changing to zero of the signal $\overline{RST}$ the output signals of the memory device are adapted to the output signals of the counter 401, i.e., the memory device is reset.

The left cam shaft continues turning until it reaches the end position generating the signal $\overline{EINDST}$, whereby the signal $\overline{RST}$ via flipflop 429 becomes one again and the signal Q12 via flipflop 423 becomes also one, thereby opening the gate 414. At the same time the signal $\overline{EINDST}$ adopts the signals $\overline{PRT}$ and $\overline{RST}$ with respect to gate 435. Now the sorting device is again in the situation wherein the next copy will be transported into the first bin of the left sorting box. The subsequent operation is completely identical as described with respect to the assortment of the copies of the first original according to method B.

Figure 22:
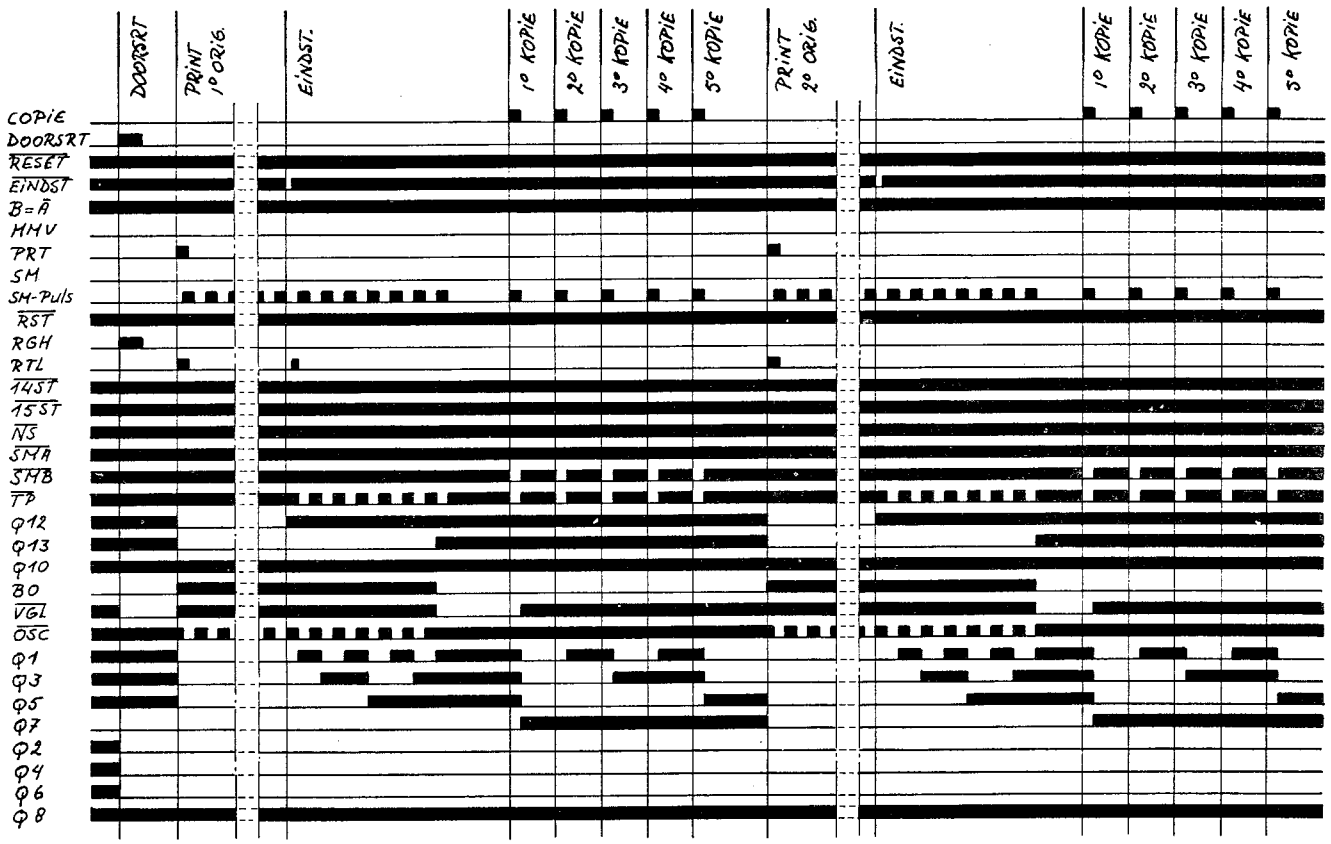
FIG. 22 is a diagrammatic illustration of the signal values versus time in a case of sorting method B combined with a sorting-up mode of operation.

In FIG. 22 the operation of the control circuit of FIG. 19 is schematically represented for the case that sorting method B has been selected, and that seven copies have been made of a defined number of originals and are assorted according to method B, and whereupon the switch 184 is actuated for a short period of time in order to make five copies of each original of a next set of originals and to assort these copies according to method B in the next five bins. By actuating the switch 184 for a short period of time, the signal. $\overline{DOORSRT}$ is generated whereby the signal RGH becomes one whereby the memory device 402 adopts the situation of the counter 401 and the signal $\overline{VGL}$ becomes zero.

The signals have then the values represented in FIG. 22 left with respect to "PRINT 1° ORIG".

As the print knob of the copying apparatus then is actuated the signal $\overline{PRT}$ is generated whereby the signal RTL becomes one, the signal Q12 zero and the signal Q13 zero, because the output signal of the comparative circuit is one. Since the memory device 402 is not reset, the signal $\overline{NS}$ does not become zero. Because the signal Q12 becomes zero the gate 414 is blocked, whereas the oscillator is started because the output signal Q13 becomes zero, the pulses of which oscillator are transmitted to the left stepping motor, but not to the counter 401.

The left cam shaft continues turning until it reaches its endposition, at which moment the signal $\overline{EINDST}$ is generated whereby the output signal Q12 becomes one again and the gate 414 is opened. The oscillator continues operation and its pulses are now transmitted to the stepping motor as well as to the counter 401.

As soon as the counter 401 reaches the number corresponding to the number of the memory device 402 the signal $\overline{VGL}$ becomes zero whereby the signal Q13 becomes one again and the oscillator is stopped. Because the memory device is set to the number seven, for the examples cited above, the counter also reaches the number seven and the stepping motor is turned till the position wherein the next copy will be transported into the eighth bin. It must be noted that all this happens in the time before the first copy has left the copying apparatus. When thereupon the first copy is transported into the eighth bin the operation is further identical as described with respect to FIG. 21, with the difference that the counter starts counting from seven and not from zero.

When the second original is put into the copying apparatus the operation remains almost identical as described with respect to FIG. 21, with the difference that the stepping motor is turned till the position wherein the copy is transported into the eighth bin.

This operation of sorting up has been described here by way of example in the case of seven copies having been made of the first set of originals. In case more than 15 copies have been made of the first set of originals, the operation is slightly different because at sorting up the signal SM has become one and if now the signal DOORSRT is generated, the output signal of the gate 419 becomes zero whereby the signal Q10 becomes also zero and the signal Q11 remains one whatever being the input signals 422*b* and 422*c* of the flipflop 420.

A special case is also present when 15 copies are made of the first original, sorting method B has been selected and the second original is put into the copying apparatus. For this case the operation of the circuit of FIG. 19 is schematically represented in FIG. 23*a*. Because 15 copies have been made of the first original, the signal SM has become one and the counter has been reset (see FIG. 21 at the location of the fifteenth copy). When now the print knob is actuated the signal Q12 becomes zero, whereby the gate 414 is blocked, the signal NS becomes zero thus making the signal $\overline{\text{RST}}$ zero, and the singal SM becomes zero. So the left stepping motor is actuated again and because the left cam shaft is stopped in an undefined position, the oscillator is started and the left cam shaft turned until the end position is reached. In this way the same situation is reached as described with respect to FIG. 21 at the location of "PRINT 2*e* ORIG". When thereupon the first and next copies are deposited, the operation is in no way different than to the operation described with respect to FIG. 21.

In the FIGS. 23*b* and 23*c* the operation of the circuit is represented in the case of the sorting apparatus being reset, in FIG. 23*b* in case the first seven bins have been used, and in FIG. 23*c* in case the first 21 bins have been used.

It is immaterial whether these situations were obtained via sorting method A or via sorting method B.

In the case of the first seven bins having been used the signals have the values represented in FIG. 23*b*. By actuating the knob reset, the signal DOORSRT is initially generated. Thereby the output signal of the gate 434 becomes one, whereas this signal DOORSRT does not influence the output signal of the gate 419 because the signal SM is zero. In that the output signal of the gate 434 becomes one the memory device 402 is caused to open whereby the number set in the counter 401 is adopted by the memory device 402. Thereupon the signal RESET is generated, whereby the output signal of the flipflop 429 becomes zero, i.e., the output signal of the gate 434 remains one and that of the gate 435 becomes one, whereby the counter 401 is reset and the memory device 402 adopts the inverse of the condition of the counter.

At the same time the ouput signal of the gate 433 becomes one thereby starting the oscillator, the pulses of which being transmitted to the left stepping motor via the gate 413 and to the counter 401 via the gates 414 and 415, the counter being however in the non active state. The left stepping motor continues turning until the associated cam shaft reaches its end position.

At that moment the flipflop 429 is reset, whereby the signal $\overline{\text{RST}}$ becomes one again, thus making the output signals of the gates 434, 435 and 433 zero again and stopping the oscillator. By the resetting at the same time of the counter and of the memory device, the output signal of the comparative circuit becomes also zero again.

In case 21 bins have been used, as represented in FIG. 23*c*, the operation principally is identical, with this difference that the changing to zero of the output signal of the flipflop 429 resets the flipflop 416 thereby making the signal SM zero.

As soon as the signal $\overline{\text{RESET}}$ has been generated, i.e., before the oscillator is started, the left stepping motor is actuated again. From the above it becomes clear that always the situation is achieved represented as start position in FIG. 20.

In the case of 21 bins, the signal DOORSRT is initially generated, as already mentioned. Because at that moment the signal SM is one and therefore the right stepping motor is activated the output signal of the gate 419 becomes zero and therefore also the output signal of the flipflop 416.

When thereupon the signal RESET is generated, the output signal of the flipflop 416 becomes one again. At that moment the flipflop 420 can be reset again i.e., the signal SM can become zero.

It is clear, that the invention is not restricted to the embodiment herein described and illustrated and that numerous modifications can be made without deviating from the concept of the invention. For example the receiving trays can be constructed in other ways, as well as the reversing mechanism 260. Further it is possible to couple together more sorting apparatus, for instance, by also installing the lowest receiving tray in the right sorting box so that it is displaceable and installing a transport mechanism below this tray, to which mechanism a following sorting apparatus of the same type is joined.

Further, it is not necessary that the receiving trays be installed horizontally. More particularly, for instance, receiving trays installed at an angle to the horizontal may be used, with the scraping organs and the transport mechanism for the sheets being situated on and near their upper extremities. Also other arrangements for the specific arrangement of the guide organs are within the scope of the invention and possible.

Further, it is possible to modify the signal generators, for instance, the generator of the signal $\overline{\text{EINDST}}$. In another embodiment of this signal generator, a reflective or white surface is provided on each cam shaft, instead of the above mentioned recess, and a light source and a phototransistor are provided opposite to the cam shaft, whereby every time the cam shaft reaches its end position the light from the light source is reflected onto the phototransistor, rendering it conductive. This signal can, for example, by means of a Schmitt-trigger be modified into a signal $\overline{\text{EINDST}}$.

Figure 15:
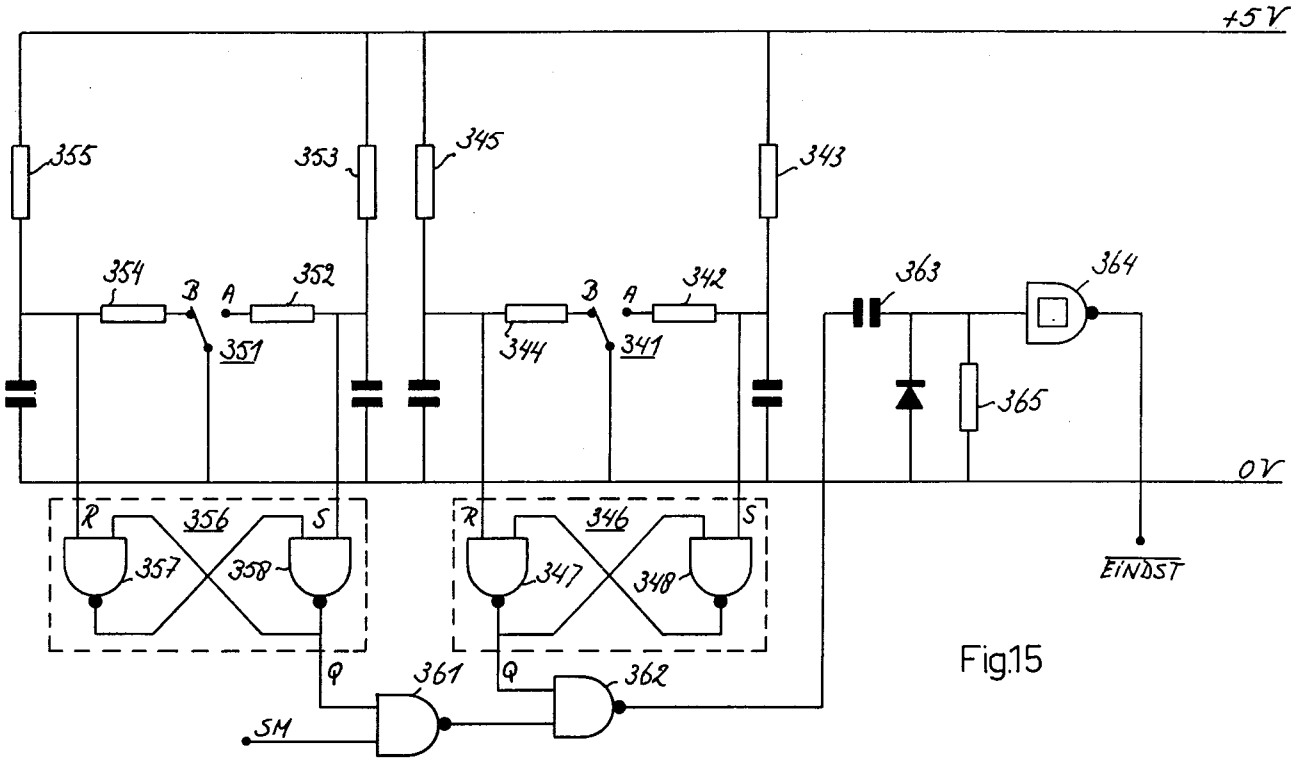
FIG. 15 is a diagram of the electric circuit of the signal generator for the signal EINDST.

Additionally, it may be noted that in FIG. 15 the signal SM as an input signal of the gate 361 is not necessary, because there is always only one cam shaft which can be turned, so that if a signal $\overline{\text{EINDST}}$ is generated, this signal must be generated by means of the cam shaft which is at that moment operative.

Figure 14:
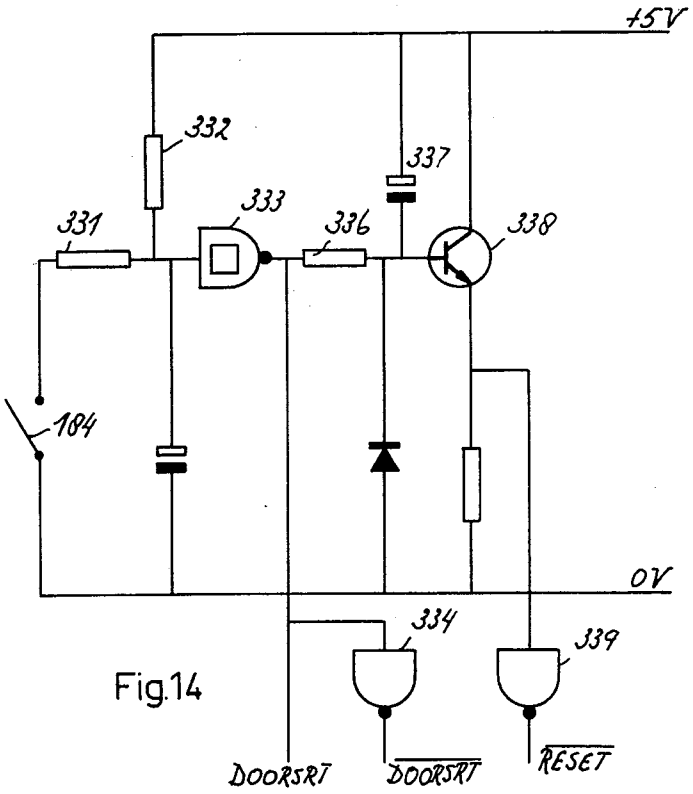
FIG. 14 is a diagram of the electric circuit of the signal generator for the signals DOORSRT and RESET.

In another modified embodiment, the signals DOORSRT and RESET can be generated by means of two separate switches, and not by means of one switch, as described with respect to FIG. 14.

Further it is possible to connect the on/off switch of the sorting apparatus to a circuit whereby the signal RESET is generated every time the device is swiched on. This then be the only method by which the device can be reset.

Finally, it is also possible to provide one more external switch at every actuation of which the sorting apparatus can be shifted over one bin, i.e., the activated stepping motor turns through one step. Such a circuit may be identical to the circuit comprising the elements 321, 323 and 325 of FIG. 13, the photoresistor 291 being replaced by a switch.

The output signal of the gate 325 may be named the signal $\overline{STAP}$, which can be used as a fourth input of the gate 413 in FIG. 19.

What I claim is:

1. Apparatus for the assorted collection of sheets, comprising a. a series of bins situated along a track;

b. means for transporting sheets to be assorted in succession along said track;

c. means positionable selectively in said track for diverting either a sheet or a succession of sheets from said track into any selected one of said bins;

d. control means for positioning said diverting means so as to divert the successive sheets into predetermined bins respectively pertaining to said sheets, said control means including 1. means for changing positions of said diverting means so as to divert sheets selectively into a predetermined number of said bins counted along said track, 2. means for producing a signal for each change of position of said diverting means to divert a sheet or sheets into a further bin of said predetermined number of bins, 3. means for registering each said signal and producing count conditions respectively corresponding to the number of said signals produced as said positions are changed to divert said sheets into said predetermined number of bins and 4. a memory device connected with said registering means for storing a signal condition corresponding to the count condition produced by said registering means when said diverting means have been positioned to divert a sheet or sheets into the last bin of said predetermined number of bins; and e. sorting-up means operable according to said signal condition stored in said memory device after sheets have been diverted selectively into said predetermined number of bins for causing said diverting means to be positioned further so as to divert sheets selectively into bins subsequent in said series to said predetermined number of bins.

2. Apparatus according to claim 1, for the collection of sheets introduced successively into a track with a predetermined short time interval between successive sheets of a same group and with a longer time interval between the last sheet of one group and the first sheet of a next group, wherein said control means include

5. manually operable switch means for selecting either a first sorting method in which the sheets of a same group are diverted into the same bin or a second sorting method in which the sheets of a same group are diverted individually into different bins,

6. first sort means operative upon selection of said first method for causing said position changing means to hold said diverting means in a position to divert the sheets of a same group into the same bin, and for changing the position of said diverting means in response to an occurrence of said longer time interval so as to divert the sheets of a next group into a further bin, and

7. second sort means operative upon selection of said second method for changing the position of said diverting means in response to the delivery of each sheet of a same group into a bin so that the sheets of same group are delivered individually into certain successive bins, and means operable to change the position of said diverting means so as to divert the first sheet of a next group into the first of said certain successive bins.

3. Apparatus according to claim 2, said second sort means including sheet detecting means activated upon each delivery of a sheet into a bin and gate means connected for activation by signals from said detecting means, said switch means and said registering means when said switch means has been operated to select said second sorting method.

4. Apparatus according to claim 1, said sorting-up means including a manually operable switch member for activating said memory device and sort-simulating means rendered operable upon operation of said switch member for causing said position changing means to effect, in simulation of sorting, changes of position of said diverting means corresponding to those by which sheets were diverted selectively into said predetermined number of bins.

5. Apparatus according to claim 4, said sort-simulating means comprising means for delivering pulses for operating said position changing means and means for comparing the count conditions in said registering means and said signal condition in said memory device and activating said pulse delivering means at the signal condition existing in said memory device when a sheet or sheets have been diverted selectively into the last bin of said predetermined number of bins, said comparing means being operative thereafter to inactivate said pulse delivering means when the count condition in said registering means corresponds to said signal condition in said memory device.

6. Apparatus according to claim 1, said diverting means comprising a plurality of guide organs, one for each of said bins, which are each movable independently of others to and fro relative to said track between a first position outside said track and a second position in which the respective guide organ protrudes into said track to divert a sheet or sheets therefrom, said position changing means including a shaft having thereon a series of members respectively operable by movement of said shaft to displace said guide organs and a stepping motor for moving said shaft in steps by which said guide organs are displaced in succession.

7. Apparatus for the assorted collection of sheets introduced successively into a track with a predetermined short time interval between successive sheets of a same group and with a longer time interval between the last sheet of one group and the first sheet of a next group, comprising a. a series of bins situated along said track;

b. means for transporting sheets to be assorted in succession along said track;

c. means positionable selectively in said track for diverting either a sheet or a succession of sheets from said track into any selected one of said bins, said diverting means comprising a plurality of guide organs, one for each of said bins, which are each movable independently of others to and fro relative to said track between a first position outside said track and a second position in which the respective guide organ protrudes into said track to divert a sheet or sheets therefrom;

d. control means for positioning said diverting means so as to divert the successive sheets into predetermined bins respectively pertaining to said sheets, said control means including 1. means for changing positions of said diverting means so as to divert sheets selectively into a predetermined number of said bins counted along said track, said position changing means including a shaft having thereon a series of members respectively operble by movement of said shaft to displace said guide organs and a stepping motor for moving said shaft in steps by which said guide organs are displaced in succession;

2. means for producing a signal for each change of position of said diverting means to divert a sheet or sheets into a further bin of said predetermined number of bins, 3. means for registering each said signal and producing count conditions respectively corresponding to the number of said signals produced as said positions are changed to divert said sheet or sheets into said predetermined number of bins, 4. a memory device connected with said registering means for storing a signal condition corresponding to the count condition produced by said registering means when said diverting means have been positioned to divert a sheet or sheets into the last bin of said predetermined number of bins, 5. manually operable switch means for selecting either a first sorting method in which the sheets of a same group are diverted into the same bin or a second sorting method in which the sheets of a same group are diverted individually into different bins, 6. first sort means operative upon selection of said first method for causing said position changing means to hold said diverting means in a position to divert the sheets of a same group into the same bin, and for changing the position of said diverting means in response to an occurrence of said longer time interval so as to divert the sheets of a next group into a further bin, and 7. second sort means operative upon selection of said second method for changing the position of said diverting means in response to the delivery of each sheet of a same group into a bin so that the sheets of a same group are delivered individually into certain successive bins, and means operable to change the position of said diverting means so as to divert the first sheet of a next group into the first of said certain successive bins, said second sort means including sheet detecting means activated upon each delivery of a sheet into a bin and gate means connected for activation by signals from said detecting means, said switch means and said registering means when said switch means has been operated to select said second sorting method; and e. sorting-up means operable according to said signal condition stored in said memory device after sheets have been diverted selectively into said predetermined number of bins for causing said diverting means to be positioned further so as to divert sheets selectively into bins subsequent in said series to said predetermined number of bins, said sorting-up means including a manually operable switch member for activating said memory device and sort-simulating means rendered operable upon operation of said switch member for causing said position changing means to effect, in simulation of sorting, changes of position of said diverting means corresponding to those by which sheets were diverted selectively into said predetermined number of bins, said sort-simulating means comprising means for delivering pulses for operating said position changing means and means for comparing the count conditions in said registering means and said signal condition in said memory device and activating said pulse delivering means at the signal condition existing in said memory device when a sheet or sheets have been diverted selectively into the last bin of said predetermined number of bins, said comparing means being operative thereafter to inactivate said pulse delivering means when the count condition in said registering means correspond to said signal condition in said memory device.

* * * * *

UNITED STATES PATENT OFFICE

CERTIFICATE OF CORRECTION

Patent No. 4,026,539 Dated May 31, 1977

Inventor(s) Theodorus Knoops

It is certified that error appears in the above-identified patent and that said Letters Patent are hereby corrected as shown below:

Column 8, line 58, in place of "a new" read -- anew --.
Column 11, line 55, delete "is".
Column 12, line 13, in place of "Texan" read -- Texas --.
Column 12, line 25, delete "is".
Column 14, line 3, in place of "positioned" read -- position --.
Column 16, line 46, in place of "whenn" read -- when --.
Column 16, line 53, in place of "connection" read -- connected --
Column 16, line 66, insert -- zero -- after "becomes".
Column 18, line 5, delete "provide --.
Column 18, line 6, after "to" insert -- provide --.
Column 20, line 56, in place of "are", second occurrence, read -- one --.
Column 21, line 14, in place of "however" read -- However --.
Column 21, line 50, in place of "is", first occurrence, read -- if --.
Column 22, line 38, in place of "is" read -- if --.
Column 22, line 39, in place of "if" read -- is --.
Column 23, line 2, before "having" insert -- each --.
Column 24, line 64, in place of "FIGURE" read -- FIGURES --.
Column 25, line 3, in place of "select" read -- selected --.
Column 25, line 33, in place of "supported" read -- supposed --.
Column 26, line 20, delete "is".
Column 26, line 25, in place of "socalled" read -- so-called --, and in place of "positin" read -- position --
Column 26, line 38, in place of "fourteen" read -- fourteenth --.
Column 26, line 30, in place of "become" read -- becomes --.
Column 26, line 31, in place of "become" read -- becomes --.
Column 29, line 34, in place of "singal" read -- signal --.

UNITED STATES PATENT OFFICE

CERTIFICATE OF CORRECTION

Patent No. 4,026,539 Dated May 31, 1977

Inventor(s) Theodorus Knoops Page 2 of 2

It is certified that error appears in the above-identified patent and that said Letters Patent are hereby corrected as shown below:

Column 31, line 9, in place of "swiched" read -- switched --.
Column 31, line 10, after "This" insert -- may --.
Column 33, line 25, in place of "operble" read -- operable --.

Signed and Sealed this

*Fifteenth* Day of *November 1977*

[SEAL]

*Attest:*

RUTH C. MASON
*Attesting Officer*

LUTRELLE F. PARKER
*Acting Commissioner of Patents and Trademarks*